US007597498B2

(12) United States Patent
Cheng

(10) Patent No.: US 7,597,498 B2
(45) Date of Patent: Oct. 6, 2009

(54) POSITIVE LOCK RING BINDER MECHANISM

(75) Inventor: Hung Yu Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 140 days.

(21) Appl. No.: 11/688,735

(22) Filed: Mar. 20, 2007

(65) Prior Publication Data

US 2007/0160416 A1 Jul. 12, 2007

Related U.S. Application Data

(62) Division of application No. 10/870,168, filed on Jun. 17, 2004, now Pat. No. 7,275,886.

(60) Provisional application No. 60/553,231, filed on Mar. 15, 2004.

(51) Int. Cl.
*B42F 13/00* (2006.01)
*B42F 3/04* (2006.01)
*B42F 13/20* (2006.01)

(52) U.S. Cl. ..... 402/73; 402/26; 402/37; 402/38

(58) Field of Classification Search ..... 402/19, 402/20, 26, 27, 29, 30, 35, 38, 39, 40, 41, 402/500, 65, 70, 73, 74, 75, 77, 80 P, 80 R; D19/26, 27

See application file for complete search history.

(56) References Cited

U.S. PATENT DOCUMENTS 566,717 A 8/1896 Krah
651,254 A 6/1900 Krah (Continued)

FOREIGN PATENT DOCUMENTS

EP 1316438 A1 6/2003

(Continued)

OTHER PUBLICATIONS

Kokuyo Lock Ring Mechanism with description, two instruction sheets, and nine photographs, undated but admitted as prior art, 12 pgs.

(Continued)

*Primary Examiner*—Dana Ross
*Assistant Examiner*—Pradeep C Battula
(74) *Attorney, Agent, or Firm*—Senniger Powers LLP

(57) ABSTRACT

A ring binder mechanism includes a housing having longitudinal ends and a top surface, hinge plates supported by the housing for pivoting motion about a pivot axis relative to the housing, and rings for holding loose-leaf pages. Each ring includes first and second ring members. The first ring member is movable relative to the second ring member between closed and opened positions of the rings. A control structure is supported by the housing and movable relative to the housing. The control structure produces the pivoting motion of the hinge plates in at least one direction. The control structure has an actuating lever pivotally connected to the housing and disposed generally above the top surface of the housing. The actuating lever is formed for receiving a fastener therethrough for connecting the housing to a cover.

21 Claims, 29 Drawing Sheets

U.S. PATENT DOCUMENTS 683,019 A 9/1901 Buchanan
790,382 A 5/1905 McBride
854,074 A 5/1907 Bryant
857,377 A 6/1907 Baker
974,831 A 11/1910 Scherzinger
1,011,391 A 12/1911 Sturgis
1,163,179 A 12/1915 Schade, Jr.
1,168,260 A 1/1916 Albrecht
1,398,034 A 11/1921 Mero
1,398,388 A 11/1921 Murphy
1,733,548 A 10/1929 Martin
1,733,894 A 10/1929 Martin
1,787,957 A 1/1931 Schade
1,822,669 A 9/1931 Schade
1,857,291 A 5/1932 Trussell
1,953,981 A 4/1934 Trussell
1,991,362 A 2/1935 Krag
1,996,463 A * 4/1935 Dawson et al. ..... 402/38
2,004,570 A * 6/1935 Dawson ..... 402/38
2,013,416 A 9/1935 McClure
2,024,461 A 12/1935 Lotter
2,067,846 A 1/1937 Cooper
2,075,766 A 3/1937 Rand
2,089,211 A 8/1937 Krag
2,096,944 A 10/1937 Unger
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis
2,251,878 A 8/1941 Hanna
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil
2,552,076 A 5/1951 Wedge
2,612,169 A 9/1952 Segal
2,789,561 A 4/1957 Bonn
2,865,377 A 12/1958 Schroer
2,871,711 A 2/1959 Stark
2,891,553 A 6/1959 Acton
2,894,513 A 7/1959 Gempe
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider
3,205,894 A 9/1965 Rankin
3,205,895 A 9/1965 Johnson
3,255,759 A 6/1966 Dennis
3,348,550 A 10/1967 Wolf
3,718,402 A 2/1973 Schade
3,748,051 A 7/1973 Frank
3,884,586 A 5/1975 Michaelis
3,954,343 A 5/1976 Thomsen
3,993,374 A 11/1976 Schudy
4,127,340 A 11/1978 Almgren
4,130,368 A 12/1978 Jacoby
4,352,582 A 10/1982 Eliasson
4,486,112 A 12/1984 Cummins
4,522,526 A 6/1985 Lozfau
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence
4,919,557 A 4/1990 Podosek
5,067,840 A 11/1991 Cooper
5,116,157 A 5/1992 Gillum
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,156 A 2/1995 Mullin
5,476,335 A 12/1995 Whaley
5,524,997 A 6/1996 von Rohrscheidt
5,577,852 A 11/1996 To
5,651,628 A 7/1997 Bankes
5,660,490 A 8/1997 Warrington
5,692,847 A 12/1997 Zane
5,692,848 A 12/1997 Wada
5,718,529 A 2/1998 Chan
5,782,569 A 7/1998 Mullin
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,888,011 A 3/1999 Reinbold, Jr.
5,895,164 A 4/1999 Wu
5,924,811 A 7/1999 To
5,957,611 A 9/1999 Whaley
5,975,785 A 11/1999 Chan
6,036,394 A 3/2000 Cheng
6,142,697 A 11/2000 Williams
6,146,042 A 11/2000 To
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 8/2001 Snyder
6,293,722 B1 9/2001 Holbrook
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 6/2004 Cheng
6,758,621 B2 7/2004 To
6,821,045 B2 11/2004 Whaley
6,840,695 B2 1/2005 Horn
6,916,134 B2 7/2005 Wong
7,275,886 B2 * 10/2007 Cheng ..... 402/73
7,478,963 B2 1/2009 Tanaka
2003/0044221 A1 3/2003 To
2003/0103798 A1 6/2003 Cheng
2003/0123923 A1 7/2003 Koike
2005/0013654 A1 1/2005 Cheng
2005/0201817 A1 9/2005 Cheng
2005/0201818 A1 9/2005 Cheng
2005/0201819 A1 9/2005 Cheng

| | | | |
|---|---|---|---|
| 2005/0201820 | A1 | 9/2005 | Ng |
| 2005/0207826 | A1 | 9/2005 | Cheng |
| 2005/0214064 | A1 | 9/2005 | Ng |
| 2005/0232689 | A1 | 10/2005 | Cheng |
| 2006/0008318 | A1 | 1/2006 | Ng |
| 2006/0056906 | A1 | 3/2006 | Horn |
| 2006/0147253 | A1 | 7/2006 | Cheng |
| 2006/0147254 | A1 | 7/2006 | Cheng |
| 2006/0147255 | A1 | 7/2006 | Cheng |
| 2006/0153629 | A1 | 7/2006 | Cheng |
| 2006/0216107 | A1 | 9/2006 | Lin |
| 2006/0228164 | A1 | 10/2006 | Horn |
| 2006/0251467 | A1 | 11/2006 | Cheng |
| 2006/0251468 | A1 | 11/2006 | Cheng |
| 2007/0086836 | A1 | 4/2007 | Cheng |
| 2007/0140778 | A1 | 6/2007 | Lin |
| 2007/0160415 | A1 | 7/2007 | To |
| 2008/0075526 | A1 | 3/2008 | Ng |
| 2008/0075527 | A1 | 3/2008 | Pi |
| 2008/0089736 | A1 | 4/2008 | Cheng |
| 2008/0124166 | A1 | 5/2008 | Zhang |
| 2009/0041532 | A1 | 2/2009 | Cheng |

FOREIGN PATENT DOCUMENTS

| | | | |
|---|---|---|---|
| EP | 1431065 | A2 | 6/2004 |
| FR | 1336765 | | 9/1963 |
| FR | 1346864 | | 12/1963 |
| FR | 2221924 | | 10/1974 |
| FR | 22221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2275023 | A | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 01299095 | A | 12/1989 |
| JP | 1299095 | A1 | 12/1989 |
| JP | 2034289 | U | 3/1990 |
| JP | 4120085 | | 10/1992 |
| JP | 2004098417 | | 2/2004 |
| WO | 0119620 | A1 | 3/2001 |
| WO | 0181099 | A1 | 11/2001 |

OTHER PUBLICATIONS

European Search Report for EP 05 25 0415 dated Jun. 9, 2005, 2 pages.

Office action issued Sep. 30, 2008 in related U.S. Appl. No. 11/080,700, 10 pgs.

Response filed Dec. 22, 2008 to Office action issued Sep. 30, 2008 in related U.S. Appl. No. 11/080,700, 6 pgs.

Office action issued May 12, 2009 in related U.S. Appl. No. 11/080,700, 12 pgs.

* cited by examiner

POSITIVE LOCK RING BINDER MECHANISM

CROSS-REFERENCE TO RELATED APPLICATIONS

This divisional patent application claims priority from U.S. patent application Ser. No. 10/870,168 filed Jun. 17, 2004, which claims the benefit of U.S. Provisional Application No. 60/553,231, filed Mar. 15, 2004. Each of these applications is incorporated herein by reference in their entireties.

BACKGROUND OF THE INVENTION

This invention relates to a ring binder mechanism for retaining loose-leaf pages, and in particular to an improved mechanism for reducing a snapping motion of ring members as they close and for securely locking the closed ring members together. This invention further relates to an improved mechanism for easily opening and closing ring members that are filled with loose-leaf pages.

As is known in the art, a typical ring binder mechanism retains loose-leaf pages, such as hole-punched papers, in a file or notebook. It generally features multiple rings, each including two ring members capable of selectively opening to add or remove pages, or selectively closing to retain pages and allow them to move along the ring members. The ring members generally mount on two adjacent hinge plates that join together about a pivot axis and pivot within an elongated housing. The housing is slightly narrower than the joined hinge plates when the hinge plates are in a coplanar position (180°). So as the hinge plates pivot through this position, they deform the resilient housing and cause a tension spring force in the housing, urging the hinge plates to pivot away from the coplanar position (180°) either opening or closing the ring members. Thus, when the ring members are closed, this spring force resists hinge plate movement and clamps the ring members together. Similarly, when the ring members are open, the spring force holds them apart. An operator may typically overcome this force by manually pulling the ring members apart or pushing them together. In addition, in some mechanisms the operator may move a lever located at one or both ends of the mechanism for moving the hinge plates through the coplanar position (180°) to open or close the ring members (in addition to manually pulling the ring members apart or pushing them together).

One drawback to these typical ring binder mechanisms is that when the ring members close, the housing's spring force snaps them together rapidly and with a force that might cause fingers to be pinched between the ring members. The spring force also makes pivoting the hinge plates through the coplanar position (180°) difficult, making both opening and closing the ring members harder. Another drawback is that when the ring members are closed, they do not positively lock together. So if the mechanism accidentally drops, the ring members may unintentionally open. Still another drawback is that over time the housing may begin to permanently deform, reducing its ability to uniformly clamp the ring members together and possibly causing uneven movements or gaps between closed ring members.

To address these concerns, some ring binder mechanisms include a control slide directly attached to the lever. These control slides have inclined cam surfaces that project through openings in the hinge plates for rigidly controlling the hinge plates' pivoting motion both when opening and closing the ring members. Examples of these types of mechanisms are shown in U.S. Pat. No. 4,566,817 to Barrett, Jr., U.S. Pat. No 4,571,108 to Vogl, and U.S. Pat. No. 6,276,862 to Snyder, et al. and in U.K. Pat. No. 2,292,343 to Kokuyo Co. Ltd. Some of these cam surfaces include a stop for blocking the hinge plate's pivoting motion when the ring members are closed, locking the closed ring members together.

But these mechanisms still have drawbacks. When the ring members close, the housing's spring force may still snap them together. The spring force may also still make both opening and closing the ring members difficult. Furthermore, the control slides in these mechanisms, specifically the cam surfaces and stops, are complexly shaped and can be difficult and time consuming to fabricate. Moreover, since the control slides directly bias the hinge plates, they are usually relatively wide and may need to be constructed of large gauge metal to withstand forces associated with repeated use (i.e., repeatedly biasing the hinge plates to pivot). Therefore the openings in the hinge plates receiving these control slides may also be relatively wide, potentially weakening the hinge plates so that they too must also be made of large gauge metal. For these reasons, mass production of these mechanisms may be more costly.

Other types of ring binder mechanisms also attempt to address the issues of avoiding snapping motion of the ring members and positively locking the ring members together. For instance, some mechanisms arrange the hinge plates so that they never pass through the coplanar position (180°) in their pivoting motion. As a result of avoiding the coplanar position (180°) of the hinge plates, the ring members do not violently snap together upon closing. However, a closing force applied to the ring members is relatively weak so that it is necessary to provide a separate locking device to keep the ring members closed. Examples of this type of ring mechanism are shown in U.S. Pat. No. 5,660,490 to Warrington and G.B. Pat. No. 952,536 to Bennett. Other mechanisms arrange the hinge plates and housing so that the hinge plates are only weakly biased by the housing. A separate wire form spring is engaged with the underside of the hinge plates to provide a bias for pivoting the hinge plates to a position in which the ring members are open. An example of this ring binder mechanism construction is shown in U.S. Pat. Appl. Publ. No. 2003/0123923 to Koike, et al.

In the mechanisms described by Warrington and Koike, et al., the ends of the ring members are formed with hooks that are engaged upon closing to hold the ring members in the closed position. It requires some dexterity to manipulate the ring members to engage and disengage them. The manipulation becomes even more difficult if the ring members are filled with loose-leaf pages. Further, the hooks are more susceptible to forces that may unintentionally open the ring binder. Moreover, ring binder mechanisms having multiple ring members requiring simultaneous engagement or disengagement of hooks may make operation more awkward and difficult.

In the mechanism described by Bennett, the actuating lever is attached to the housing between the housing's ends. One end of the lever is bent slightly greater than a right angle so it is capable of directly pivoting the hinge plates to close the ring members and is further capable of blocking their pivoting motion, holding the ring members together. But this may not positively lock the ring members closed. The lever may slide out of the blocking position if the mechanism is accidentally dropped or if the housing deforms after repeated use.

Consequently, there is a need for a ring binder mechanism that securely and positively locks ring members together for retaining loose-leaf pages, but has ring members that easily open and close as pages accumulate and that do not snap together when the ring members close. The present invention is directed to such a ring binder mechanism.

SUMMARY OF THE INVENTION

A ring binder mechanism is adapted to be fastened to a cover using at least one fastener. The ring binder mechanism generally comprises a housing, which has longitudinal ends and a top surface, and hinge plates, which are supported by the housing for pivoting motion about a pivot axis relative to the housing. The mechanism also comprises rings capable of holding the loose-leaf pages. Each ring includes two ring members. A first ring member is mounted on a first hinge plate and can move therewith relative to a second ring member. In a closed position, the two ring members form a substantially continuous, closed loop for allowing loose-leaf pages retained by the rings to be moved along the rings from one ring member to the other. In an open position, the two ring members form a discontinuous, open loop for adding or removing loose-leaf pages from the rings. Furthermore, the mechanism comprises a control structure supported by the housing for movement relative to the housing to pivot the hinge plates in at least one direction. The control structure includes an actuating lever pivotally connected to the housing generally above the housing's top surface. The actuating lever is formed for receiving the fastener therethrough, connecting the housing to the cover.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

This application contains subject matter in common with co-assigned, co-pending patent application Ser. No. 10/870,165 filed Jun. 17, 2004 for a Soft Close Ring Binder Mechanism and Ser. No. 10/870,801 filed Jun. 17, 2004 for a Ready Lock Ring Binder Mechanism, the entire texts of which are hereby incorporated by reference.

Figure 1:
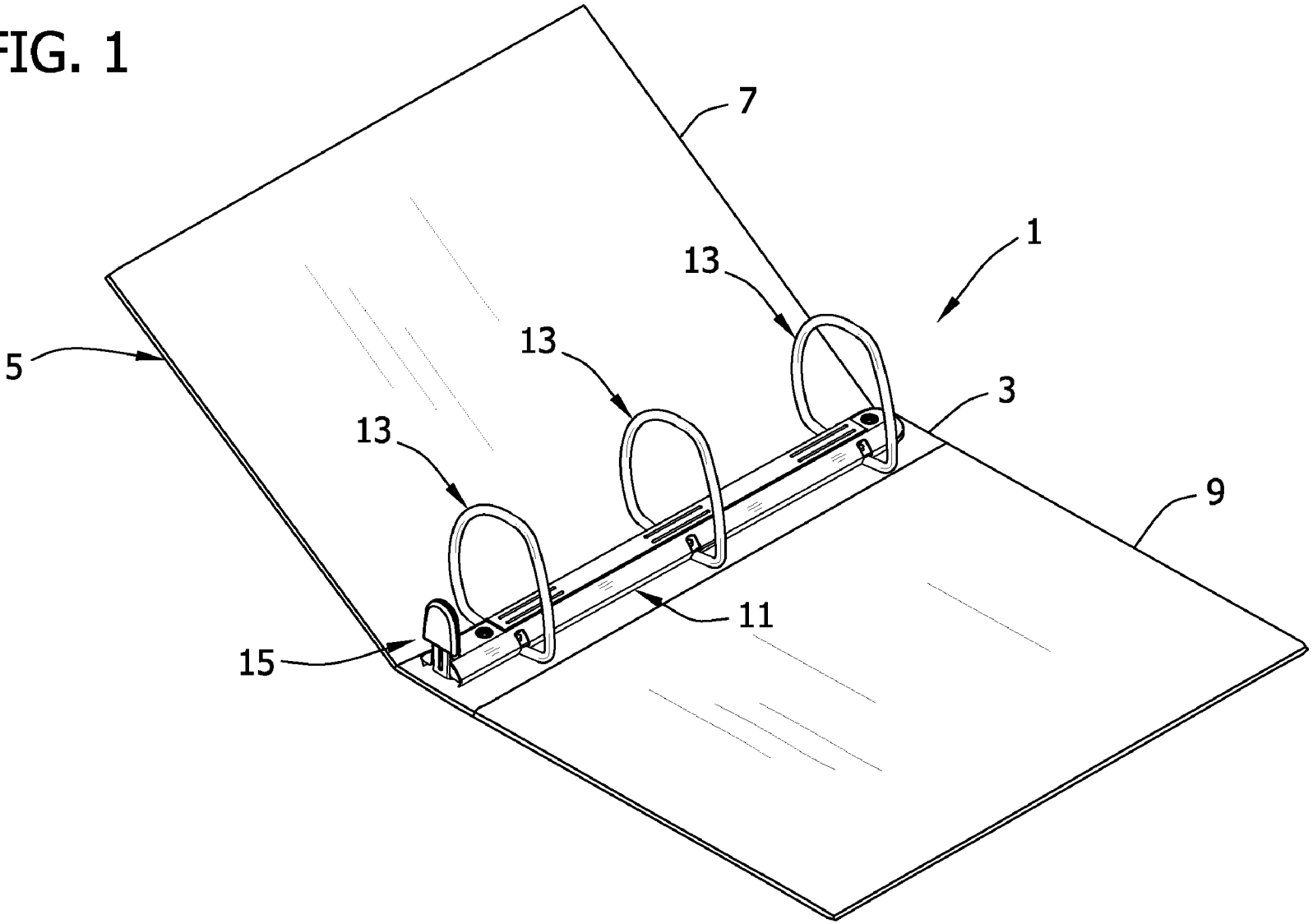
FIG. 1 is a perspective of a notebook incorporating a ring binder mechanism of the present invention according to a first embodiment.

Referring now to the drawings of the present invention, and particularly to FIG. 1, a first embodiment of a ring binder mechanism is designated generally by reference numeral 1. The mechanism 1 is capable of retaining loose-leaf pages (not shown) and is shown mounted on a spine 3 of a notebook 5 having a front cover 7 and a back cover 9 hingedly attached to the spine. The front and back covers 7, 9 move to selectively cover or expose retained pages. The mechanism 1 generally includes a housing 11, three rings 13, and a control structure 15 (the reference numbers indicating their subjects generally). Ring binder mechanisms mounted on surfaces other than a notebook, however, do not depart from the scope of this invention. As shown in FIGS. 2A-3B, the housing 11 supports the control structure 15 and the rings 13. As will be discussed hereinafter, the control structure 15 is movable relative to the housing 11 for either closing and locking the mechanism 1 to retain pages on the rings 13 or opening it to load pages on or remove pages from the rings 13.

Figure 4:
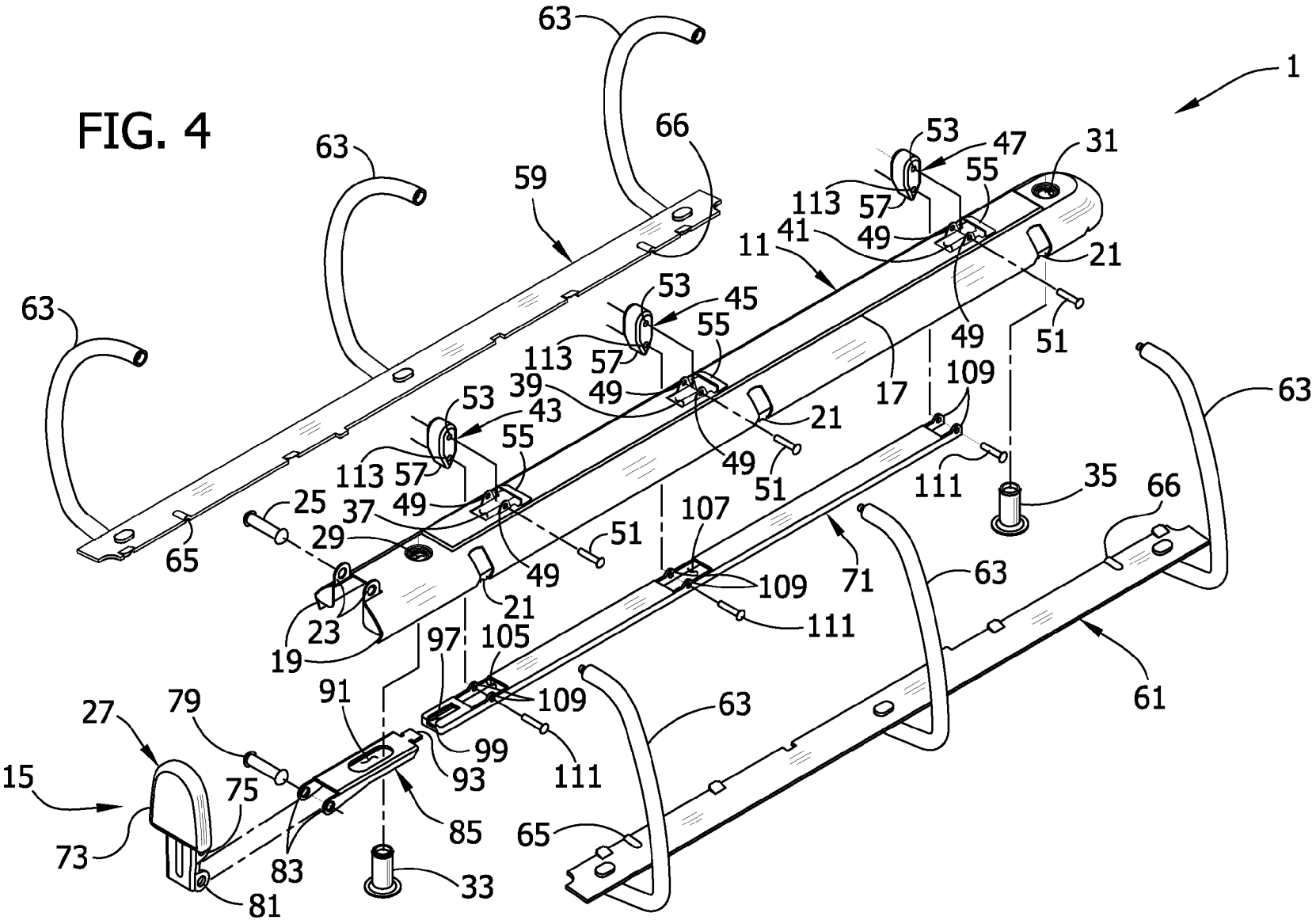
FIG. 4 is an exploded perspective of the ring binder mechanism.

The housing 11, shown in FIG. 4 is elongate with a symmetrically, roughly arch-shaped cross section having a raised plateau 17 at its center. The housing 11 has a longitudinal axis, two transversely opposite longitudinally extending edges, and two longitudinal ends. It is envisioned that the housing 11 is made of metal, but it may be made of other material that is sufficiently rigid to provide a stable mount for components of the mechanism 1 while being sufficiently resilient to function as a spring. A bent under rim 19 is formed along both longitudinal edge margins of the housing. Together, the two bent under rims 19 have six total slots 21 (only three of which are visible) arranged in three transversely opposed pairs along the length of the housing 11 for accommodating the rings 13. At one longitudinal end of the housing, two tabs 23 project upward and receive a first hinge pin 25 for mounting an actuating lever 27 of the control structure on the housing 11. The opposite end of the housing does not have a lever, although it is understood that a mechanism with two actuating levers or a mechanism with the actuating lever attached between its ends does not depart from the scope of this invention.

The raised plateau 17 of the housing includes five openings. Two openings 29, 31 are circular and receive and attach mounting posts 33, 35 capable of securing the mechanism 1 to the notebook 5. The other three openings 37, 39, 41 are rectangular and receive part of first, second, and third locking elements 43, 45, 47 of the control structure respectively. Each rectangular opening 37, 39, 41 includes two tabs 49 projecting upward. Each pair of tabs receives a hinge pin 51 passing through an upper opening 53 in the respective locking element 43, 45, 47, pivotally attaching the locking element 43, 45, 47 to the housing 11. The raised plateau 17 further includes three stalls 55 adjacent to each rectangular opening 37, 39, 41. Each stall 55 is pressed slightly upward from the raised plateau 17 and receives part of a cam surface 57 of each locking element 43, 45, 47 when the control structure 15 moves to open the mechanism 1. It is understood that different shaped housings, including asymmetrical ones, and housings with different numbers or shapes of openings or slots do not depart from the scope of this invention.

Figure 2A:
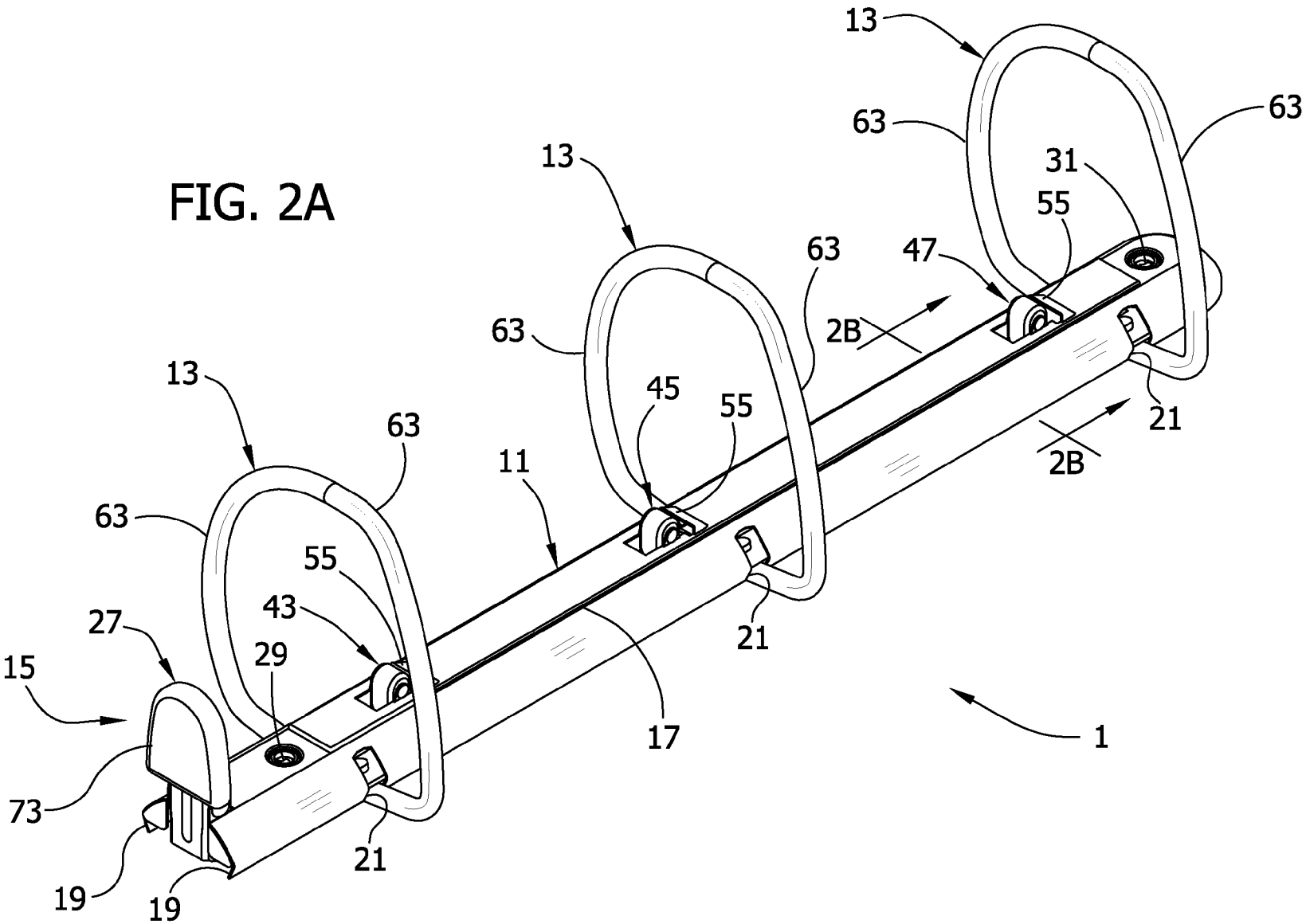
FIG. 2A is a perspective of the ring binder mechanism at a closed and locked position.
Figure 2B:
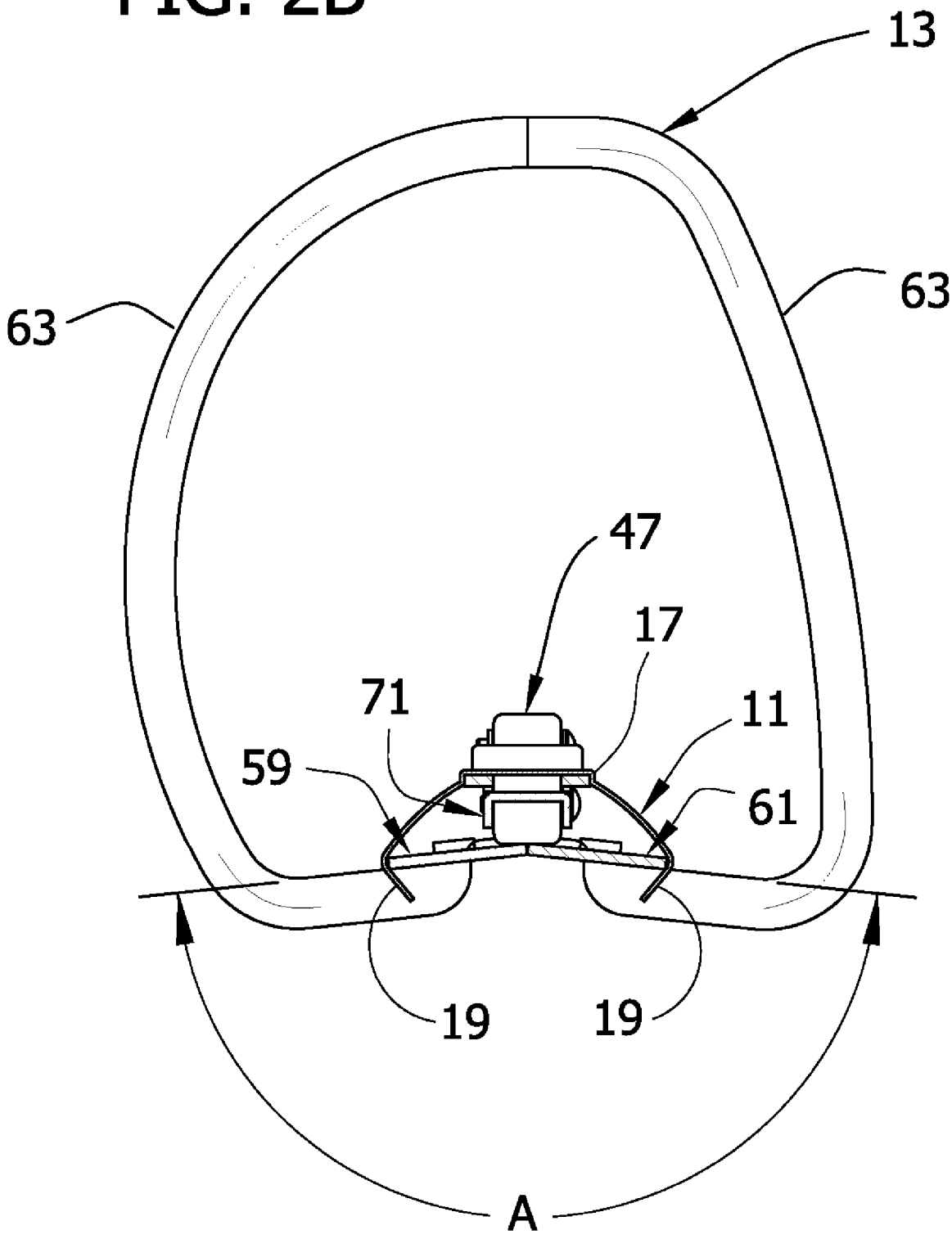
FIG. 2B is a section taken on line 2B-2B of FIG. 2A.
Figure 3A:
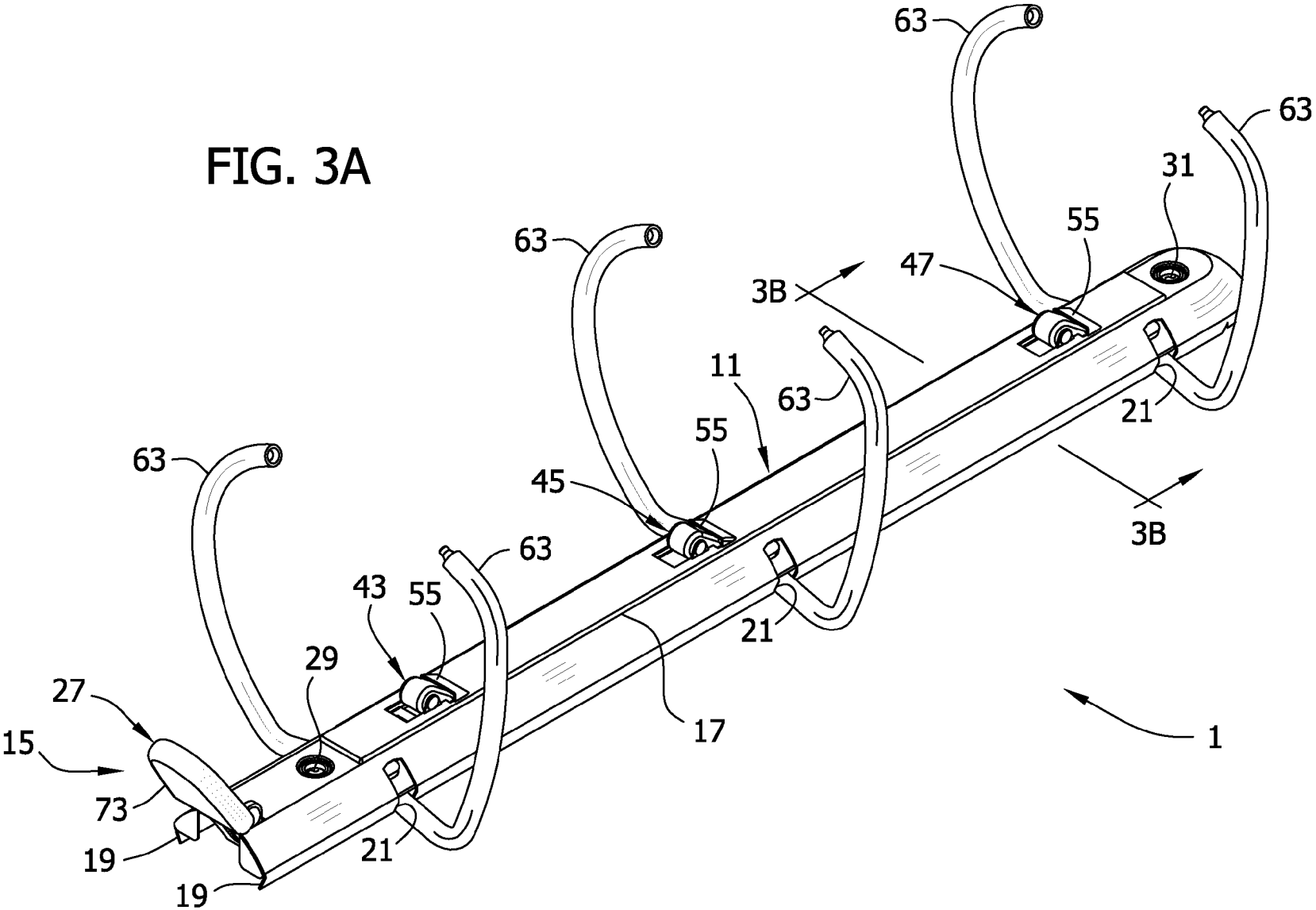
FIG. 3A is a perspective similar to FIG. 2A with the mechanism at an open position.
Figure 3B:
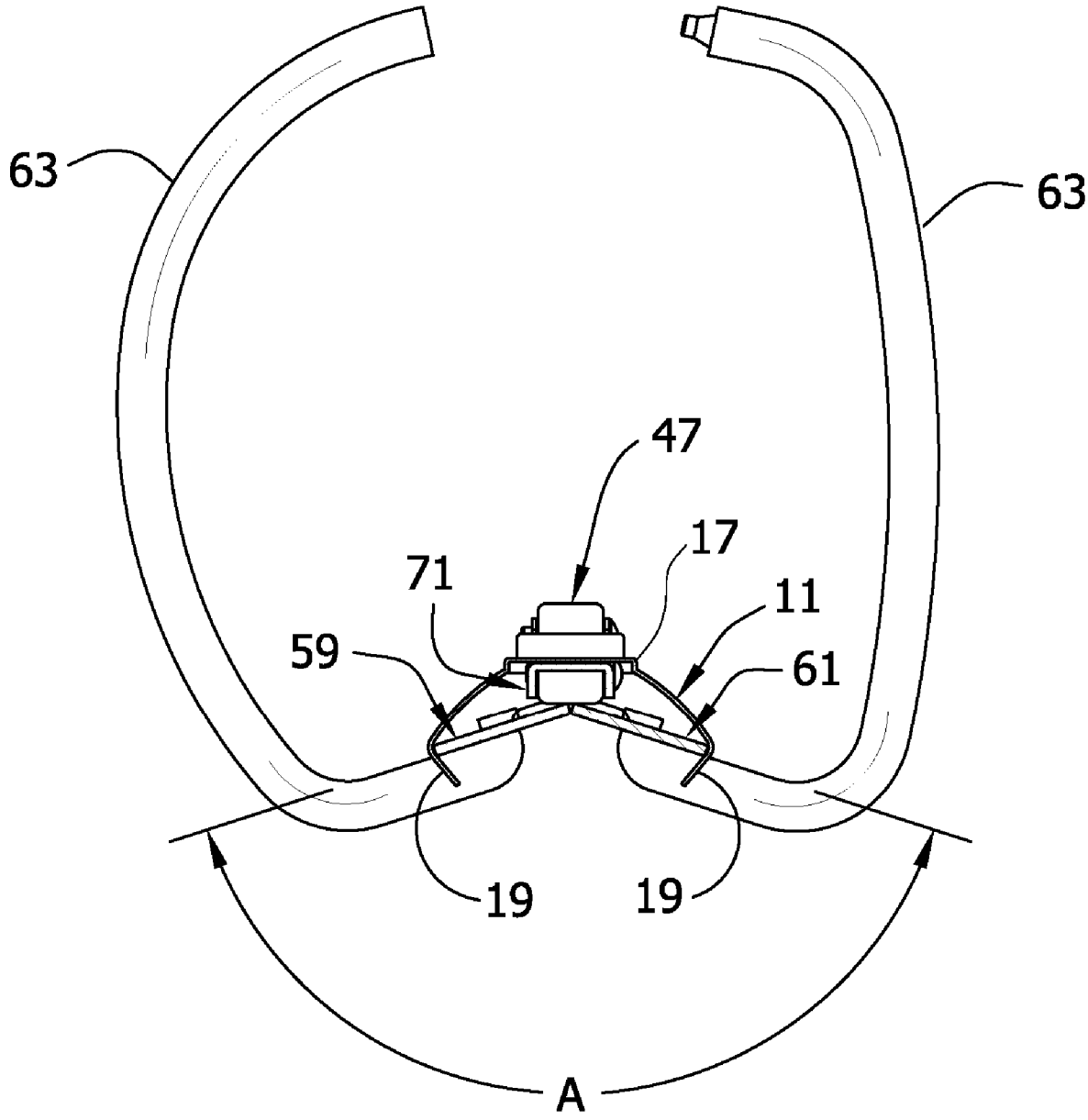
FIG. 3B is a section taken on line 3B-3B of FIG. 3A.

Referring to FIGS. 2A, 3A, and 4, each ring 13 includes two ring members 63 mounted on one of two respective hinge plates 59, 61. The two hinge plates 59, 61 are supported by the housing 11 for pivoting motion, and the ring members 63 move therewith between a closed position and an open position. The ring members 63 are generally circular in cross section and are formed of suitable material such as steel. In the closed position, the ring members 63 form a substantially continuous, closed, "D"-shaped ring or loop (see FIG. 2B) for retaining loose-leaf pages and for allowing the pages to move along the rings 13 from one ring member 63 to the other. In the open position, they form a discontinuous, open loop (see FIG. 3B) suitable for adding or removing pages. Although in the illustrated embodiment both ring members can move, a mechanism having one movable ring member and one fixed does not depart from the scope of this invention. Additionally, a mechanism with more or fewer than three rings or with rings that form other shapes when closed does not depart from the scope of this invention.

Figure 5A:
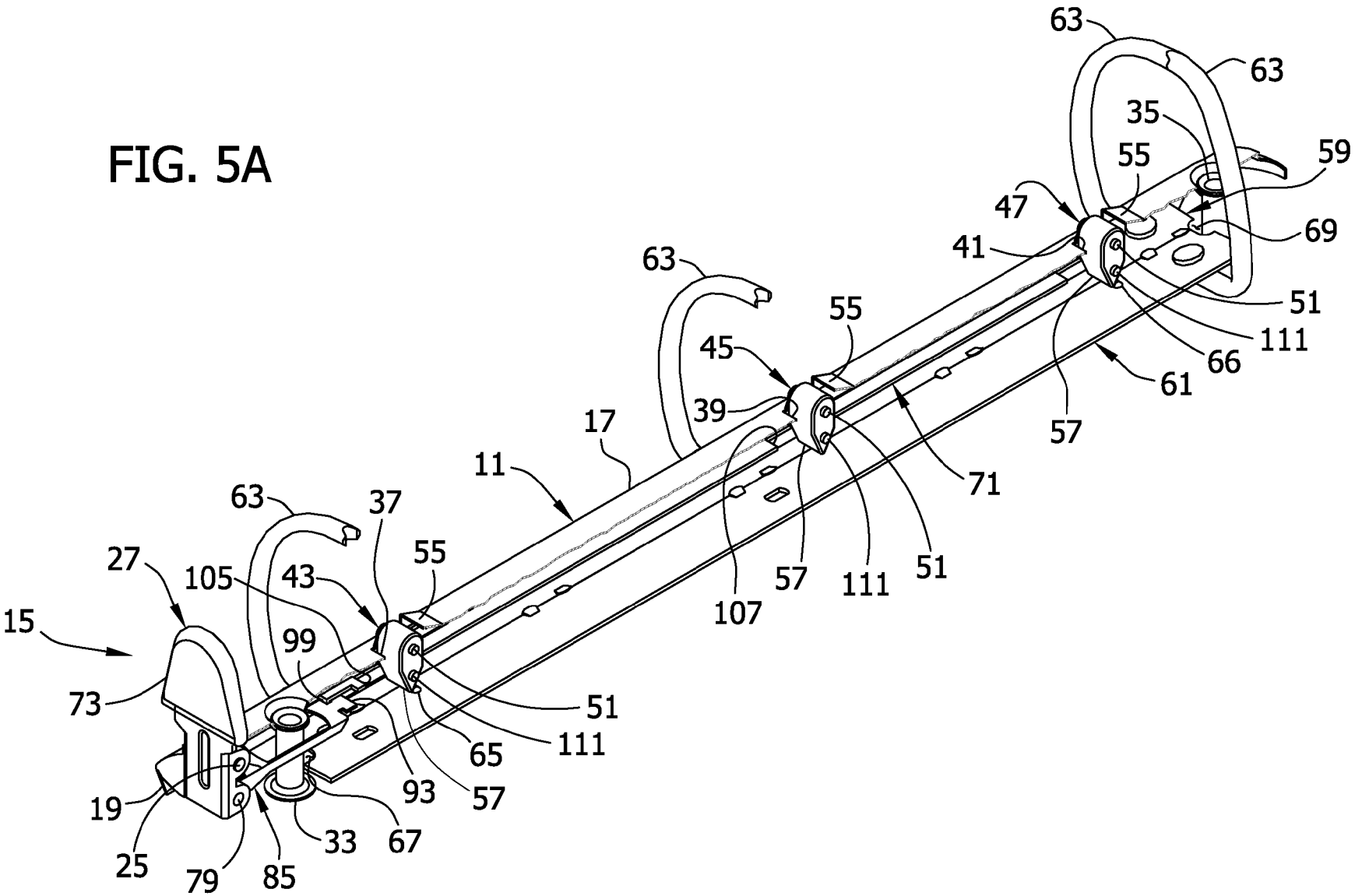
FIG. 5A is the perspective of FIG. 2A with a portion of a housing, a travel bar, and ring members broken away.
Figure 5B:
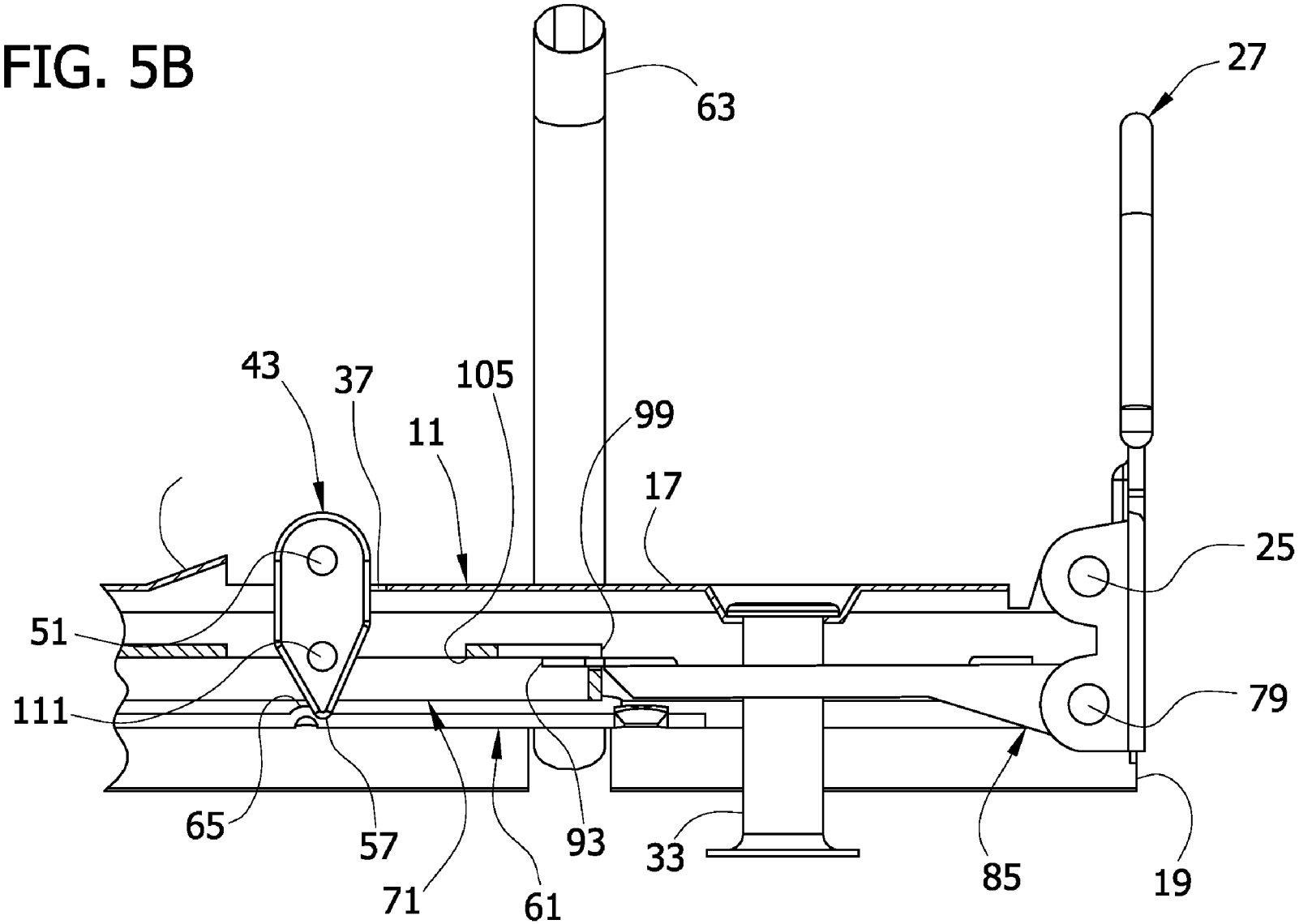
FIG. 5B is an enlarged, fragmentary longitudinal section of the ring binder mechanism of FIG. 2A.

The hinge plates 59, 61 are generally each a thin, elongate sheet having inner and outer longitudinal edge margins, and two longitudinal ends. Each hinge plate 59, 61 includes two cutouts and two protrusion members along their inner longitudinal edge margin, with one cutout located at each longitudinal end and both protrusion members located therebetween. When the hinge plates 59, 61 interconnect, the corresponding cutouts and protrusion members of each hinge plate align. As shown in FIG. 5A, the cutouts form two openings 67, 69 for passing mounting posts 33, 35 through the interconnected hinge plates 59, 61. As further shown, the protrusion members align to define two protrusions 65, 66 that symmetrically bridge a central hinge of the interconnected hinge plates 59, 61 for releasably holding the control structure 15 in a locking position, blocking the plates 59, 61 from pivoting to open the ring members 63 (see FIG. 5B).

Referring now to FIGS. 2B, 3B, 5A, and 6A, the interconnected hinge plates 59, 61 attach to one another in parallel arrangement along their adjoining inner longitudinal edge margins, forming the central hinge, which has a pivot axis. The housing 11 receives the interconnected hinge plates 59, 61 such that each plate's outer longitudinal edge margin loosely fits behind the housing's corresponding bent under rim 19 (see FIGS. 2B and 3B). In this arrangement, the hinge plates 59, 61 are retained on the housing 11 but the edge margins are free to move behind the rims 19, allowing the hinge plates 59, 61 to freely pivot about their pivot axis. The pivot axis moves up (i.e., toward the housing's raised plateau 17) when the hinge plates 59, 61 pivot to open the ring members 63, and the pivot axis moves down (i.e., away from the housing's raised plateau 17) when the plates 59, 61 pivot to close the ring members 63.

Moreover, the hinge plates 59, 61 pivot in the housing 11 so that an angle A between exterior surfaces of the hinge plates (i.e., the surfaces facing away from the housing's raised plateau 17) is always less than 180° and the pivot axis never moves below a coplanar position of the hinge plates 59, 61 (i.e., the position where the angle A between the exterior surfaces of the hinge plates 59, 61 is 180°). Accordingly, a spring force of the housing 11 pivots the hinge plates 59, 61 for opening the ring members 63, but not for closing them. It is to be understood that an angle between exterior surfaces of hinge plates could alternatively always be greater than 180° so that a spring force of a housing pivots the hinge plates toward a closed position. Furthermore, certain embodiments of the present invention may have hinge plates arranged to pivot up and down through a coplanar position (180°) of the hinge plates.

As previously stated, the housing 11 supports the control structure 15 for movement relative to the housing. Referring back to FIG. 4, the control structure 15 of this embodiment includes the actuating lever 27, a travel bar 71, and the three locking elements 43, 45, 47. The actuating lever 27 is formed from a suitable rigid material or combination of materials, such as metal or plastic. It includes an enlarged head 73 to facilitate gripping and applying force to the lever 27. As described above, the first hinge pin 25 is received through upper openings 75 in the actuating lever and through the housing's tabs 23, mounting the lever 27 on the housing 11 for pivoting relative to the housing 11. A second hinge pin 79 is received through lower openings 81 in the actuating lever and through openings 83 in an intermediate connector 85, thereby transforming the lever's pivoting motion into substantially linear travel bar motion.

In this embodiment, the intermediate connector 85 is generally an elongate beam with a flat web and two side flanges. It includes an elongate opening 91 in the web for receiving one of the mounting posts 33 therethrough, allowing the connector 85 to move relative to the mounting post 33. It also includes a first end generally wider than a second end. More specifically, at the narrower second end, the intermediate connector 85 includes a projecting tab 93 with an enlarged end that is received in a slot 97 in a first end of the travel bar. This first end of the travel bar is bent down to form an end flange 99 against a front side of which the intermediate connector 85 can bear to push the travel bar 71. The enlarged end of the projecting tab is engageable with a back side of the end flange, allowing the intermediate connector 85 to pull the travel bar 71 toward the actuating lever 27. The slot 97 of the travel bar in which the tab 93 is received is elongate in the lengthwise direction of the travel bar 27. Thus, the intermediate connector 85 is able to freely pivot up and down with respect to the travel bar 71. Accordingly, the connector 85 transmits a linear movement from the pivoting actuating lever 27 to the travel bar 71. Moreover, the travel bar 71 can move up and down without hindrance from the intermediate connector 85. Although the travel bar's motion is not perfectly linear, it is still considered to be translational motion for purposes of the present invention.

Within the mechanism 1, the travel bar 71 is disposed generally parallel to the longitudinal axis of the housing (FIGS. 5A and 6A), under the housing's raised plateau 17 and above the hinge plates 59, 61. In this embodiment, the travel bar 71 is an elongate beam having a flat web, two side flanges, and the end flange 99 described above. The web includes two rectangular openings 105, 107 located between the ends of the travel bar for receiving part of the first and second locking elements 43, 45 through the travel bar 71. Each opening 105, 107 includes two tabs 109 projecting upward from the side flanges of the travel bar. Each pair of tabs 104 receives a hinge pin 111 passing through holes in the tabs and through a lower opening 113 in the respective locking element 43, 45, pivotally attaching the locking element 43, 45 to the travel bar 71. A second end of the travel bar 71 is open, having no end flange and having part of the web removed. At this end, two tabs 109, identical to the tabs 109 of the rectangular openings, project upward from the side flanges and receive a hinge pin 111 through a lower opening 113 in the third locking element 47, pivotally attaching this locking element 47 to the travel bar 71.

Now referring to FIGS. 4-6B, the three locking elements 43, 45, 47 of this embodiment are rectangular-shaped when viewed in elevation from the front or rear, and are generally wedge-shaped when viewed from the sides. Each locking element 43, 45, 47 includes a rounded top, a front surface, a rear surface, a rounded bottom, and two flat, parallel side surfaces. The side surfaces have the upper and lower openings 53, 113, as described above, facilitating attachment of the locking elements to the housing and travel bar. The rounded top projects upward and through the respective rectangular opening 37, 39, 41 of the housing's raised plateau 17. The front and rear surfaces angle together near the rounded bottom, forming the cam surface 57 of the locking element. The cam surface 57 passes through the respective rectangular opening 105, 107 and open second end of the travel bar. Accordingly, in this mechanism translational movement of the travel bar pivots the locking elements 43, 45, 47 to either (1) pivot the hinge plates 59, 61 for closing the ring members 63 and then block the hinge plates 59, 61 to lock the closed ring members 63 together or (2) allow the housing's spring force to pivot the hinge plates 59, 61 for opening the ring members 63. It is envisioned that each locking element of this embodiment is made of plastic or hard rubber, but other suitable materials sufficiently rigid to pivot the hinge plates and resist their movement may be used. It will be understood that control structures using more or fewer than three locking elements, or differently shaped locking elements do not depart from the scope of this invention.

FIGS. 2A-3B and 5A-6B illustrate operation of this mechanism. The control structure can selectively move the mechanism 1 to either a closed and locked position (FIGS. 2A, 2B, 5A, and 5B) or an open position (FIGS. 3A, 3B, 6A, and 6B). At the closed and locked position, the ring members 63 are together and cannot be pulled apart. The hinge plates 59, 61 are oriented so that the angle A between their exterior surfaces is at its greatest, but still less than 180° (i.e., the hinge plates' pivot axis is above the coplanar position (180°)). In addition, the actuating lever 27 is relatively vertical and the travel bar 71 is positioned closer to the housing end having the lever 27. A longitudinal axis of each locking element is generally vertical and the cam surface 57 of each element engages the hinge plates 59, 61 behind the respective protrusion 65, 66, blocking the hinge plates 59, 61 from pivoting and positively locking the ring members 63 closed. In this position, the locking elements 43, 45, 47 firmly oppose any force tending to open the ring members 63 because they are generally sized to fully occupy the area between the hinge plates 59, 61 and the housing 11. So as the hinge plates 59, 61 push up on the locking elements 43, 45, 47 (i.e., such as when the hinge plates 59, 61 pivot to open the ring members 63), the hinge plates 59, 61 immediately engage the locking elements 43, 45, 47 and tend to force the locking elements and the travel bar 71 upward. However, the housing 11 resists this movement (via the hinge pins 51 through the tabs 49) and together with the locking elements 43, 45, 47 prevents the ring members 63 from opening.

Figure 6A:
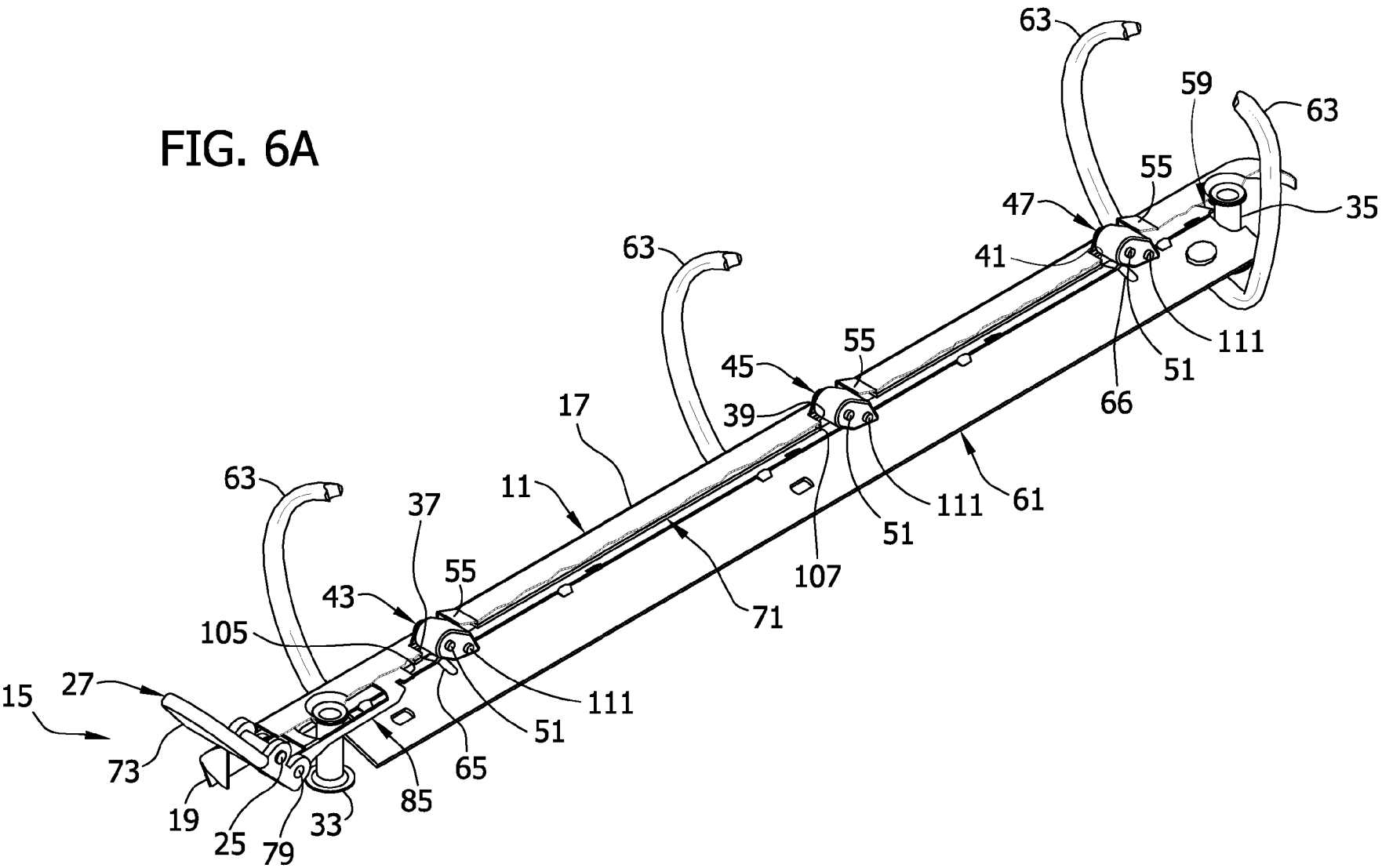
FIG. 6A is a perspective similar to FIG. 5A with the mechanism at the open position.
Figure 6B:
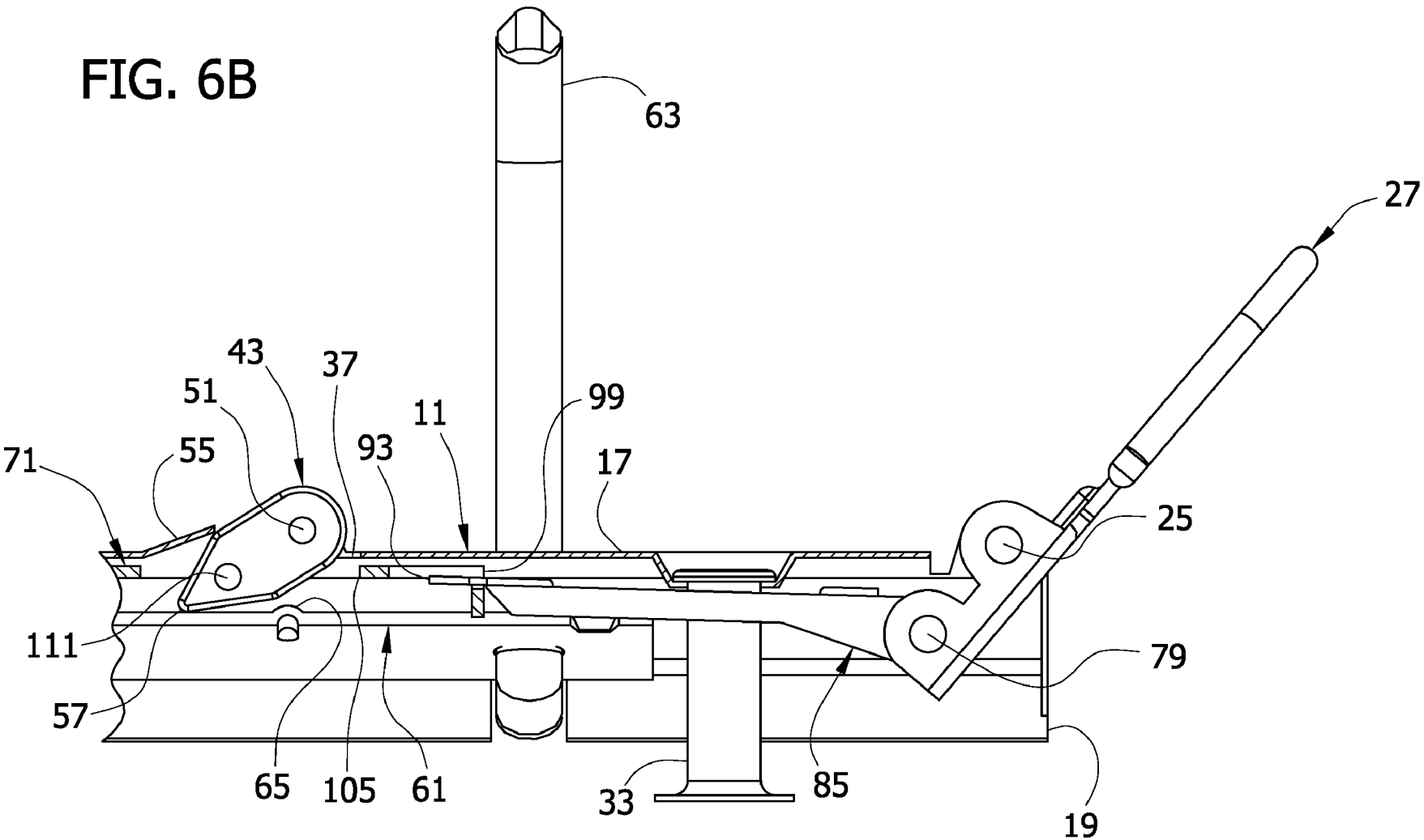
FIG. 6B is an enlarged, fragmentary longitudinal section similar to FIG. 5B with the mechanism at the open position.

To open the mechanism 1, an operator (not shown) pivots the actuating lever 27 outward and downward (FIGS. 3A and 6A). This pushes the intermediate connector 85 and travel bar 71 away from the housing end having the lever 27, causing the locking elements 43, 45, 47 to pivot. The cam surfaces 57 of the first and third locking elements begin to ride over the respective protrusions 65, 66 of the hinge plates, forcing the hinge plates 59, 61 slightly downward. As the cam surfaces 57 move past the respective protrusion 65, 66, they allow the housing's spring force to pivot the hinge plates 59, 61 upward. The cam surfaces 57 continue moving until they partially enter the housing's stalls 55, allowing the hinge plates 59, 61 to fully pivot upward and open the ring members 63. In this open position, the locking elements 43, 45, 47 no longer block the hinge plates' pivoting motion and the angle A between the hinge plates' exterior surfaces is at its smallest. The housing's spring force holds the ring members 63 open, and the operator may let go of the actuating lever 27 to load or remove pages from the mechanism 1.

To return the mechanism 1 back to the closed and locked position, the operator pivots the actuating lever 27 inward and upward (FIGS. 2A and 5A), reversing the opening movement and pulling the intermediate connector 85 and travel bar 71 back toward the housing end having the lever 27. This causes the locking elements 43, 45, 47 to pivot and move their cam surfaces 57 out of the stalls 55. As the locking elements 43, 45, 47 pivot, the cam surfaces 57 slowly move the hinge plates 59, 61 downward against the housing's spring force, gently closing the ring members 63. The cam surfaces 57 move over the respective protrusions 65, 66, and the locking elements 43, 47 are held in a position positively locking the ring members 63 closed. Indeed, the user will hear a perceptible "click" as the locking elements 43, 47 move to the locked position over the respective protrusions 65, 66 so that locking is confirmed. It is pointed out that the locking elements 43, 45, 47 of this mechanism move the hinge plates 59, 61 to pivot only for closing and locking the ring members 63. They are incapable of moving the hinge plates 59, 61 to open the ring members 63. This is accomplished by the housing's spring force.

A benefit of this mechanism, as described above, is that the locking elements 43, 45, 47 generally completely occupy the area between the hinge plates 59, 61 and the housing 11. In addition, the locking elements 43, 47 are positively held behind the respective protrusions 65, 66 of the hinge plates and are encased by the housing 11, preventing the mechanism 1 from accidentally opening. For both reasons, this mechanism 1 securely retains loose-leaf pages when the ring members 63 are closed.

This mechanism 1 also reduces the undesirable snapping motion of ring members as they close. As the operator pivots the actuating lever 27 to close the ring members 63, the locking elements 43, 45, 47 slowly and controllably move the hinge plates 59, 61 downward, gently closing the ring members 63. In addition, this mechanism 1 opens easier than prior art mechanisms. The operator need only move the travel bar 71 a short distance to pivot the locking elements 43, 45, 47 and move their cam surfaces 57 over the hinge plates' respective protrusions 65, 66 before the housing's spring force automatically pivots the plates 59, 61 to open the ring members 63. Similarly, the actuating lever's pivoting movement reduces the magnitude of force necessary to cause the travel bar movement because of the mechanical advantage given by the lever 27. Furthermore, this mechanism 1 opens and closes more easily when the ring members 63 are filled with pages. The operator can pivot the actuating lever 27 to unlock the mechanism 1 and open the ring members 63, as compared to directly manipulating ring members to unlock and open them.

Figure 7:
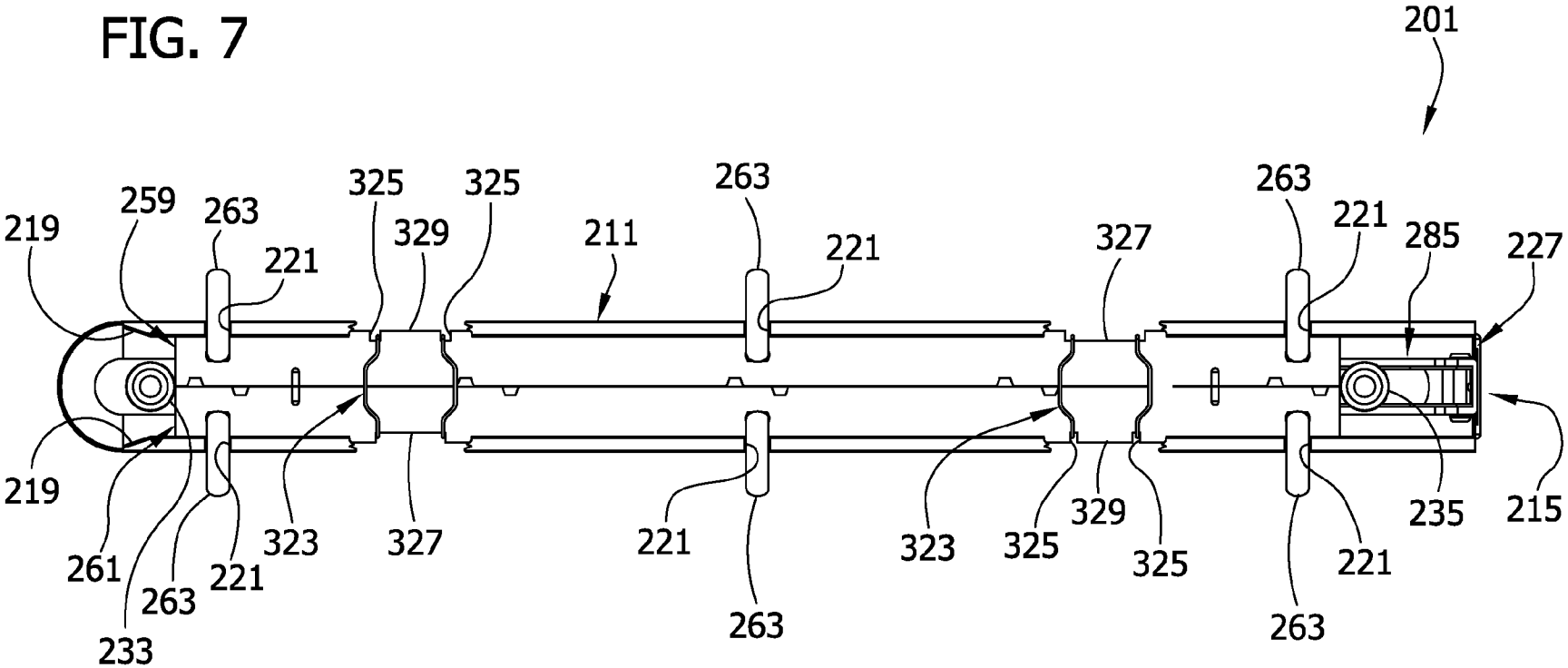
FIG. 7 is a bottom plan of a ring binder mechanism of the present invention according to a second embodiment with a portion of a housing broken away.

FIGS. 7-10B illustrate a second embodiment of the present invention, generally indicated at 201. Parts of the mechanism of this second embodiment corresponding to parts of the mechanism of the first embodiment are indicated by the same reference numerals, plus "200". This embodiment is substantially similar to the first embodiment, but as shown in FIG. 7 includes two wire form springs 323 attached to the underside of two hinge plates 259, 261 for urging the hinge plates 259, 261 to pivot and open ring members 263. To accommodate the springs 323, each hinge plate 259, 261 includes two notches 325 and one cutout 327, both located along the plate's outer longitudinal edge margin. The notches 325 are arranged relatively side-by-side and define a tab 329 therebetween. The tab 329 is toward one longitudinal end of each hinge plate and the cutout 327 is toward the other longitudinal end. The cutout 327 and tab 329 are positioned in reverse order on the two hinge plates 259, 261 so that when the plates 259, 261 interconnect along inner longitudinal edge margins, one hinge plate's cutout 327 is across from the other plate's tab 329.

Figure 8A:
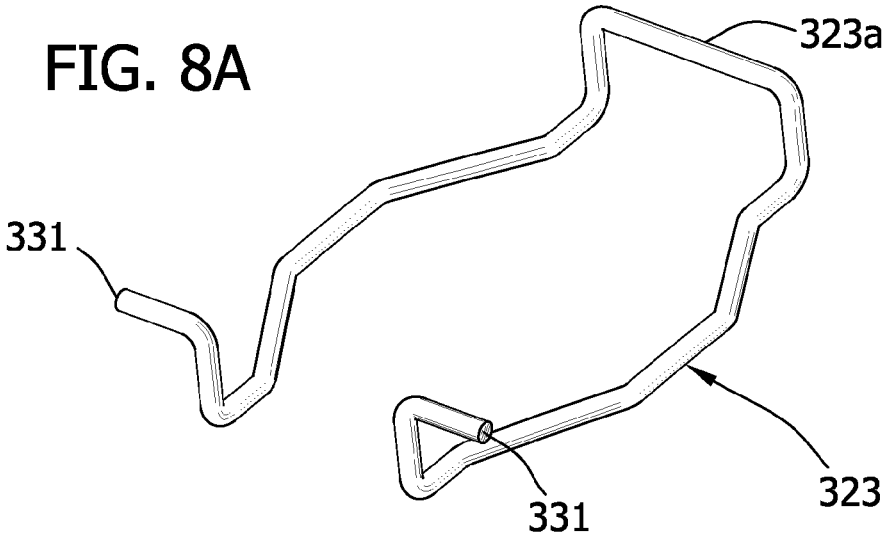
FIG. 8A is a perspective of a wire form spring of the mechanism of FIG. 7.
Figure 8B:
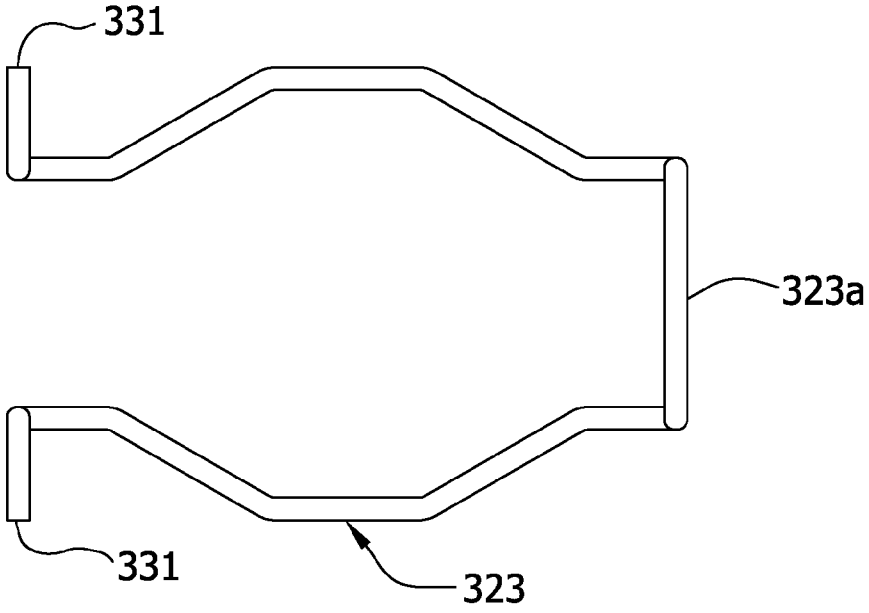
FIG. 8B is a top plan of the wire form spring of FIG. 8A.
Figure 8C:
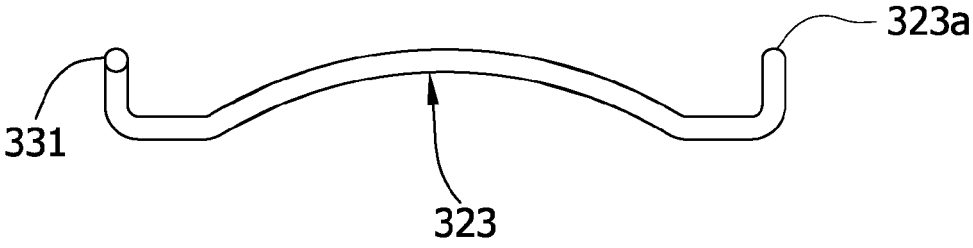
FIG. 8C is a side elevation of the wire form spring of FIG. 8A.
Figure 9A:
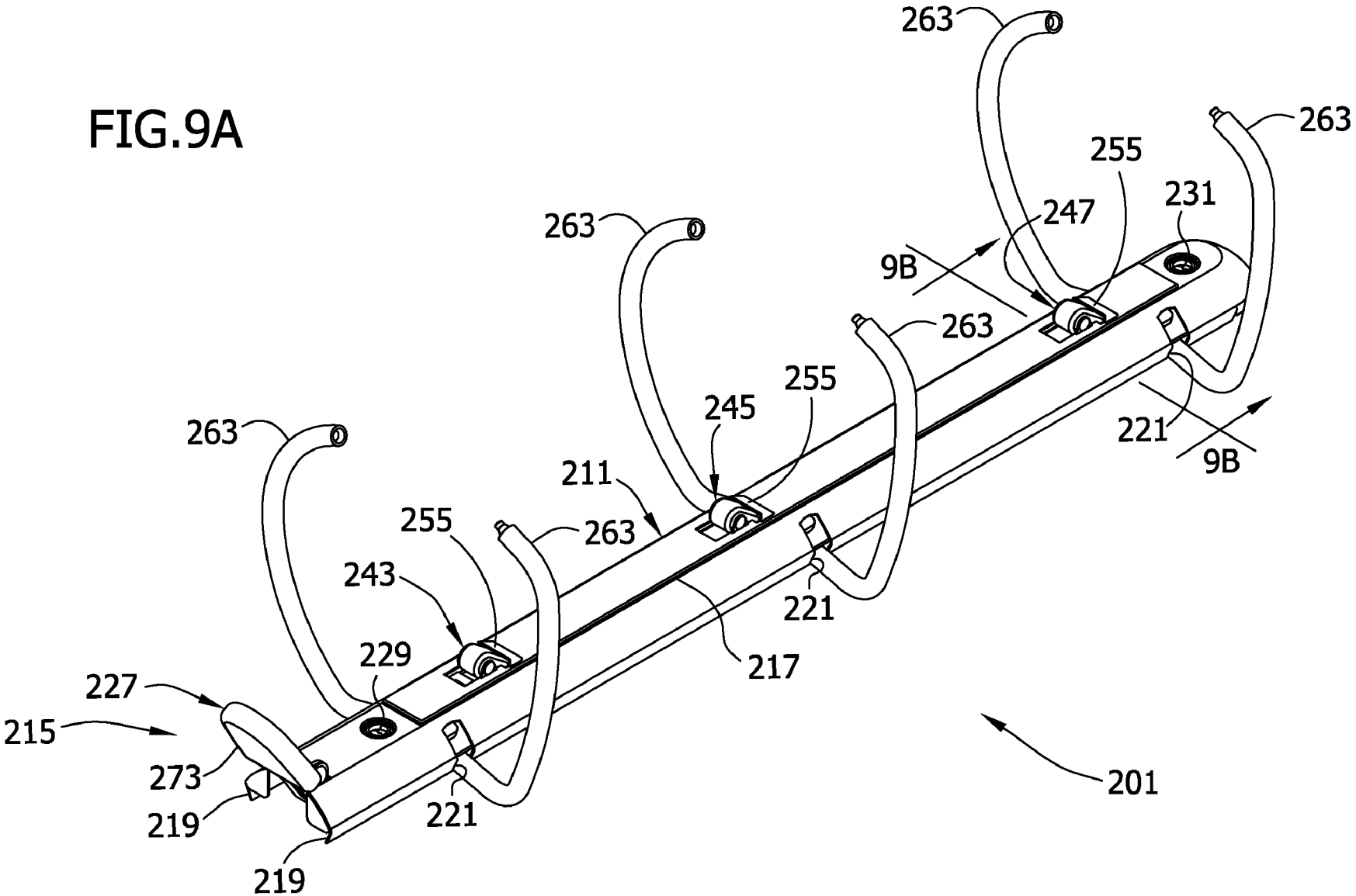
FIG. 9A is a perspective of the mechanism of FIG. 7 at an open position.
Figure 9B:
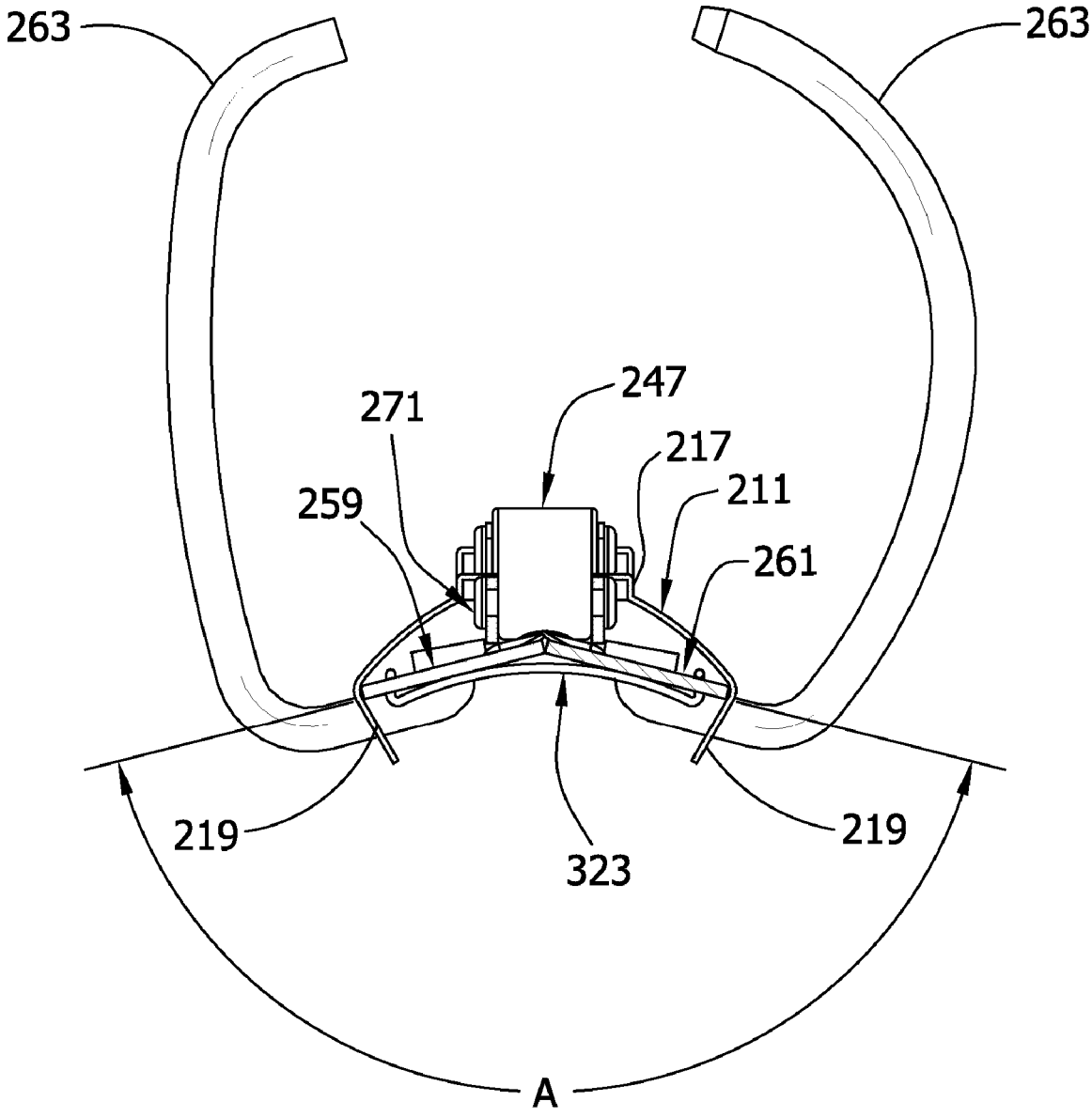
FIG. 9B is a section taken on line 9B-9B of FIG. 9A.
Figure 10A:
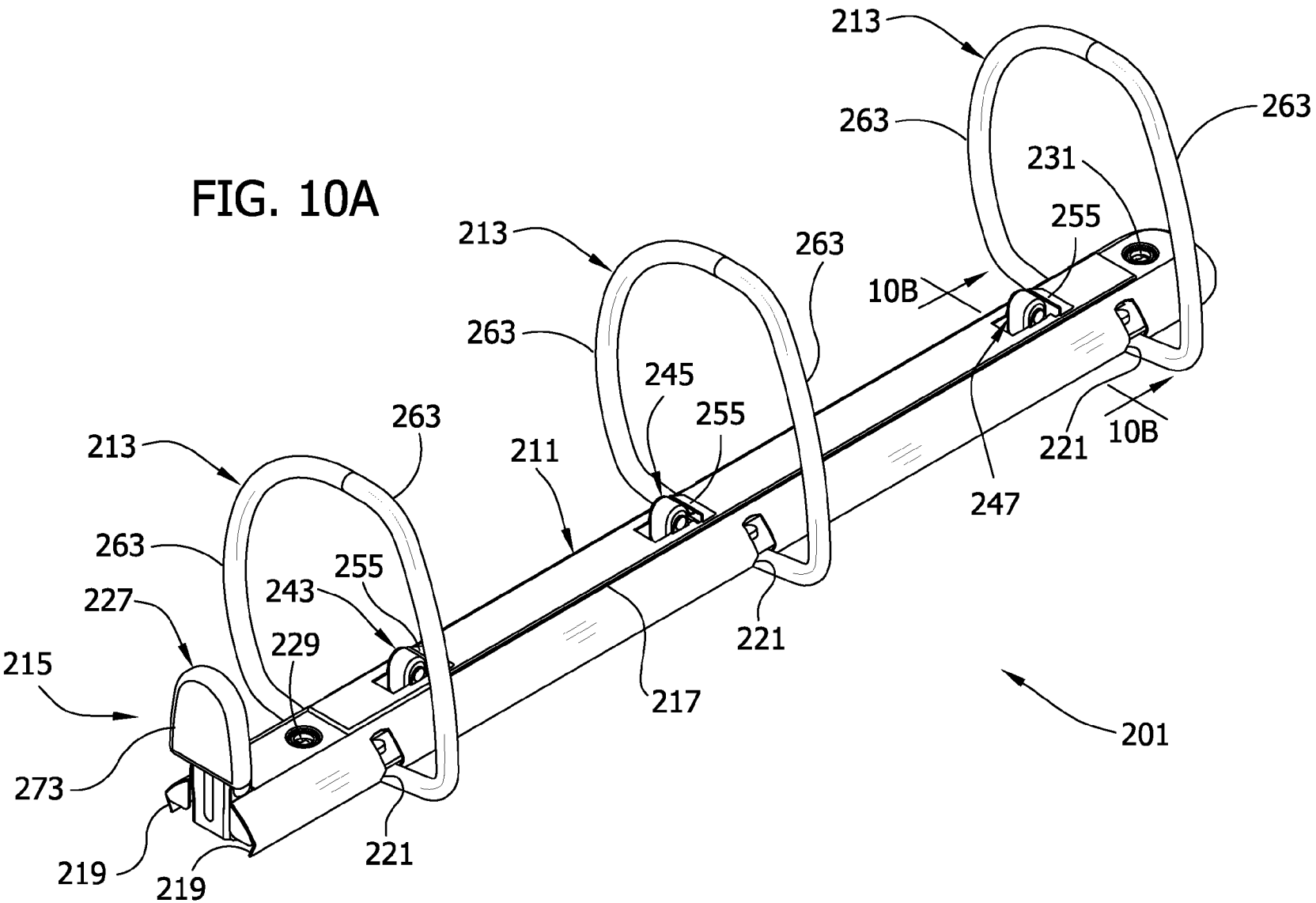
FIG. 10A is a perspective similar to FIG. 9A with the mechanism at the closed and locked position.
Figure 10B:
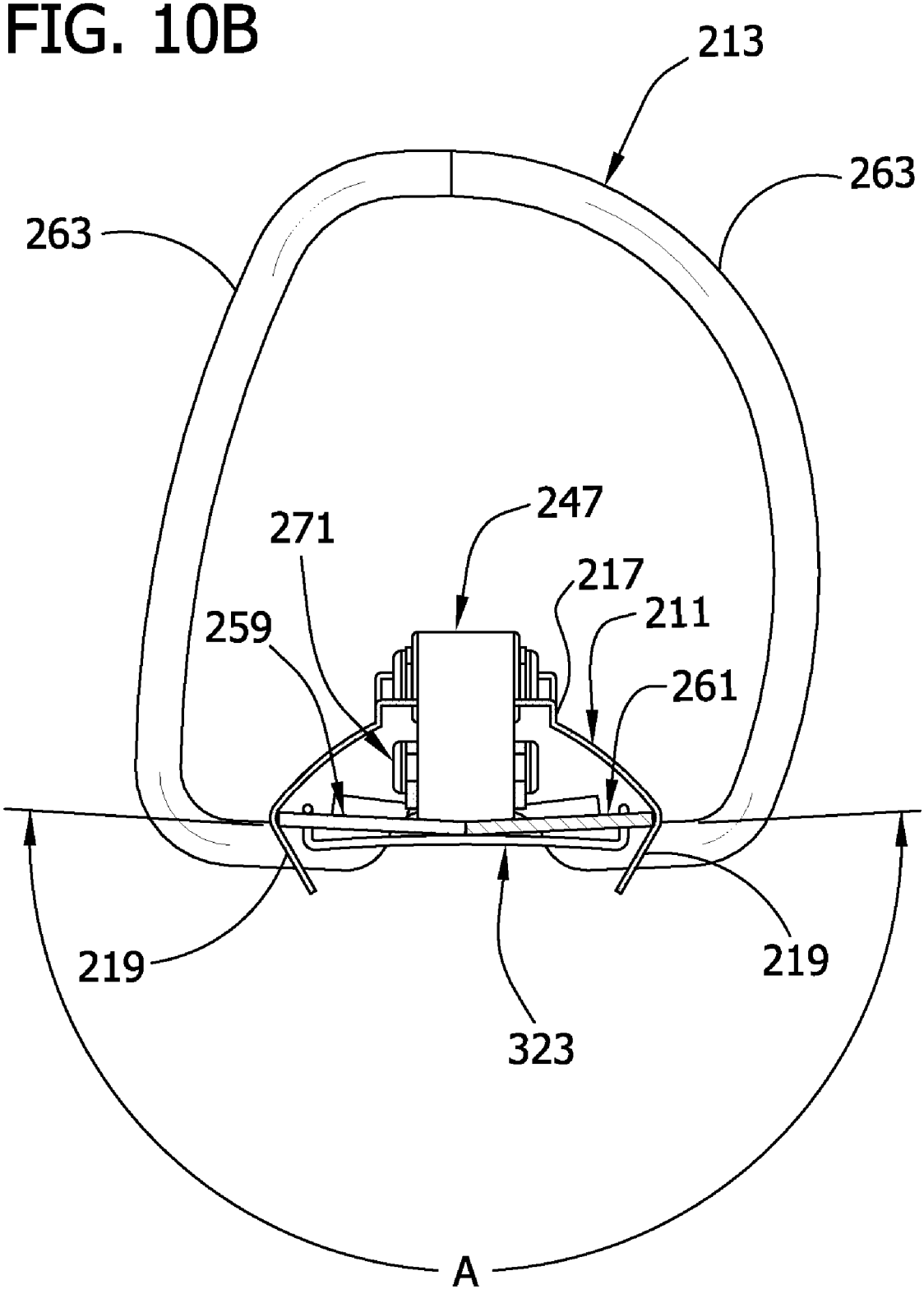
FIG. 10B is a section taken on line 10B-10B of FIG. 10.

FIGS. 8A-8C show enlarged views of the wire form spring 323. The spring 323 itself is made from a generally round wire that is formed roughly into an elongate octagon with an open end and a closed end 323*a* (the open end forming one of the sides of the octagon). The closed end 323*a* is bent upward 90° so that it fits into the notches 325 and over the tab 329 of one of the interconnected hinge plates. This allows the free end of the tab to be received behind a bent under rim 219 of a housing while the closed end 323*a* of the spring is held on the tab 329. The open end of each spring includes two wire tips 331 each bent twice into a general hook shape. A first bend is 90° upward and a second bend is 90° outward. The tips 331 are shaped to releasably fit into the cutout 327 of the opposing interconnected hinge plate. When the wire form spring 323 is attached to both plates, a bowed body of the spring is positioned substantially beneath the interconnected plates 259, 261 (the body bowing slightly upward toward the interconnected plates).

Referring to FIGS. 9A-10B, when attached, the wire form springs 323 are more relaxed (see FIG. 8C) when the hinge plates 259, 261 are oriented with the ring members 263 open. The bowed body of the spring holds the hinge plates 259, 261 in a position where exterior surfaces of the plates form an angle A that is less than 180° (i.e., the hinge plates' pivot axis is above a coplanar position of the hinge plates 259, 261). When the mechanism 201 moves to a closed and locked position (FIGS. 7, 10A, and 10B), each wire form spring 323 moderately deflects so that its bowed shape flattens, causing the springs 323 to become stressed. When the mechanism 201 moves back to the open position (FIGS. 9A and 9B), the stressed springs 323 react and automatically pivot the hinge plates 259, 261 up and through the coplanar position (180°), opening the ring members 263.

In this embodiment, the wire form springs 323 pivot the hinge plates 259, 261 to open the ring members 263. They also hold the open ring members 263 apart because, as described above, the relaxed springs 323 resist hinge plate movement tending to deflect the springs 323 and close the ring members 263. Consequently, the wire form springs 323 perform similar functions to a spring force of the housing. So a benefit of this mechanism 201 is that the housing's spring force may be reduced, or possibly eliminated, leaving only the wire form springs 323 to act on the hinge plates 259, 261. This can make moving the plates 259, 261 down and through the coplanar position (180°) easier, making this mechanism 201 easier to close.

Figure 11:
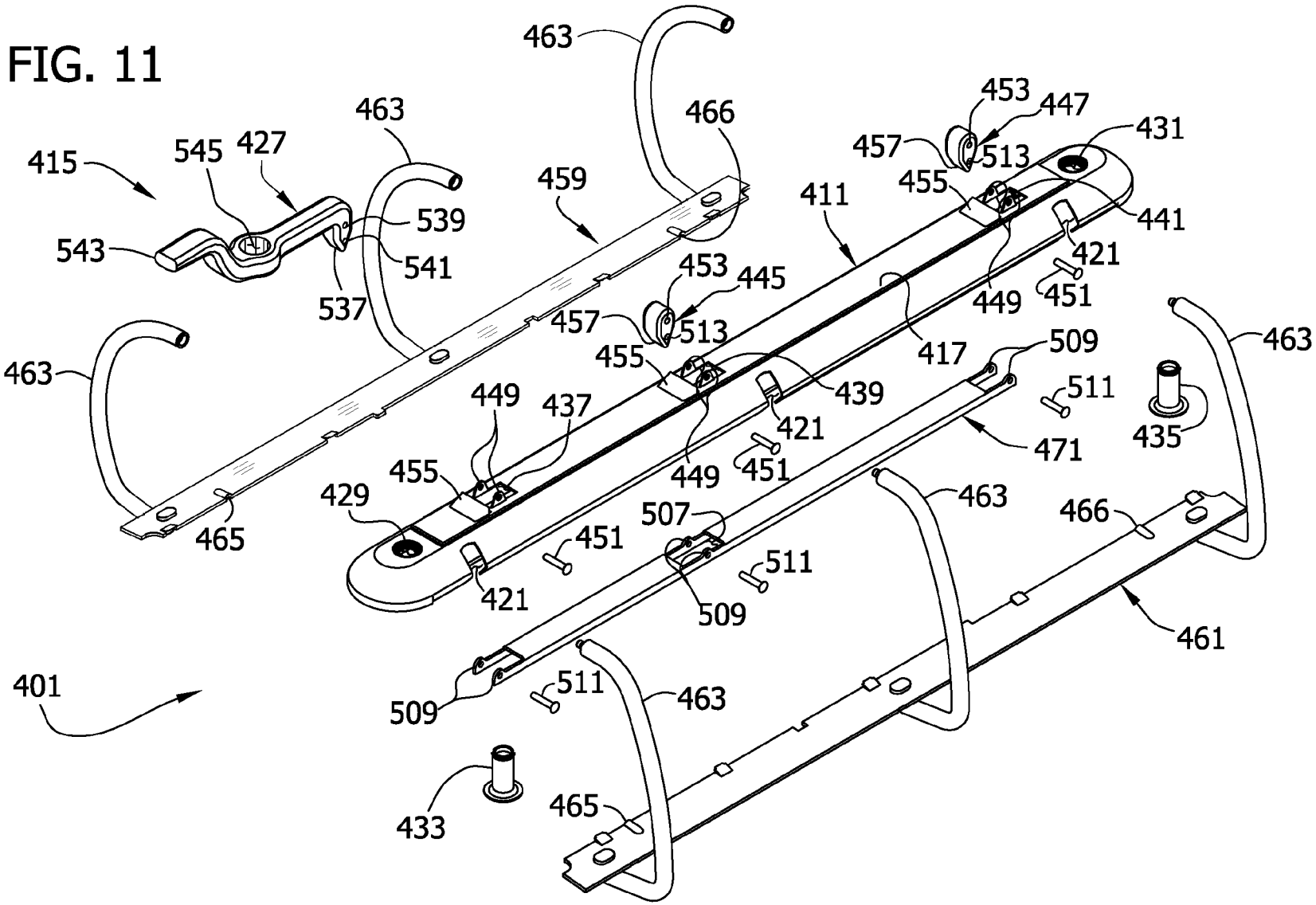
FIG. 11 is an exploded perspective of a ring binder mechanism of the present invention according to a third embodiment.

FIGS. 11-14 illustrate a third embodiment of the present invention, generally indicated at 401. Parts of this embodiment that correspond to parts of the first embodiment are indicated by the same reference numerals, plus "400". This embodiment is substantially similar to the first embodiment, but as shown in FIG. 11 includes a housing 411 having two symmetrically identical ends, with neither end having tabs for mounting an actuating lever. Instead, an actuating lever 427 of this embodiment mounts between the ends of the housing, on tabs 449 of a first rectangular opening of the housing.

Figure 14:
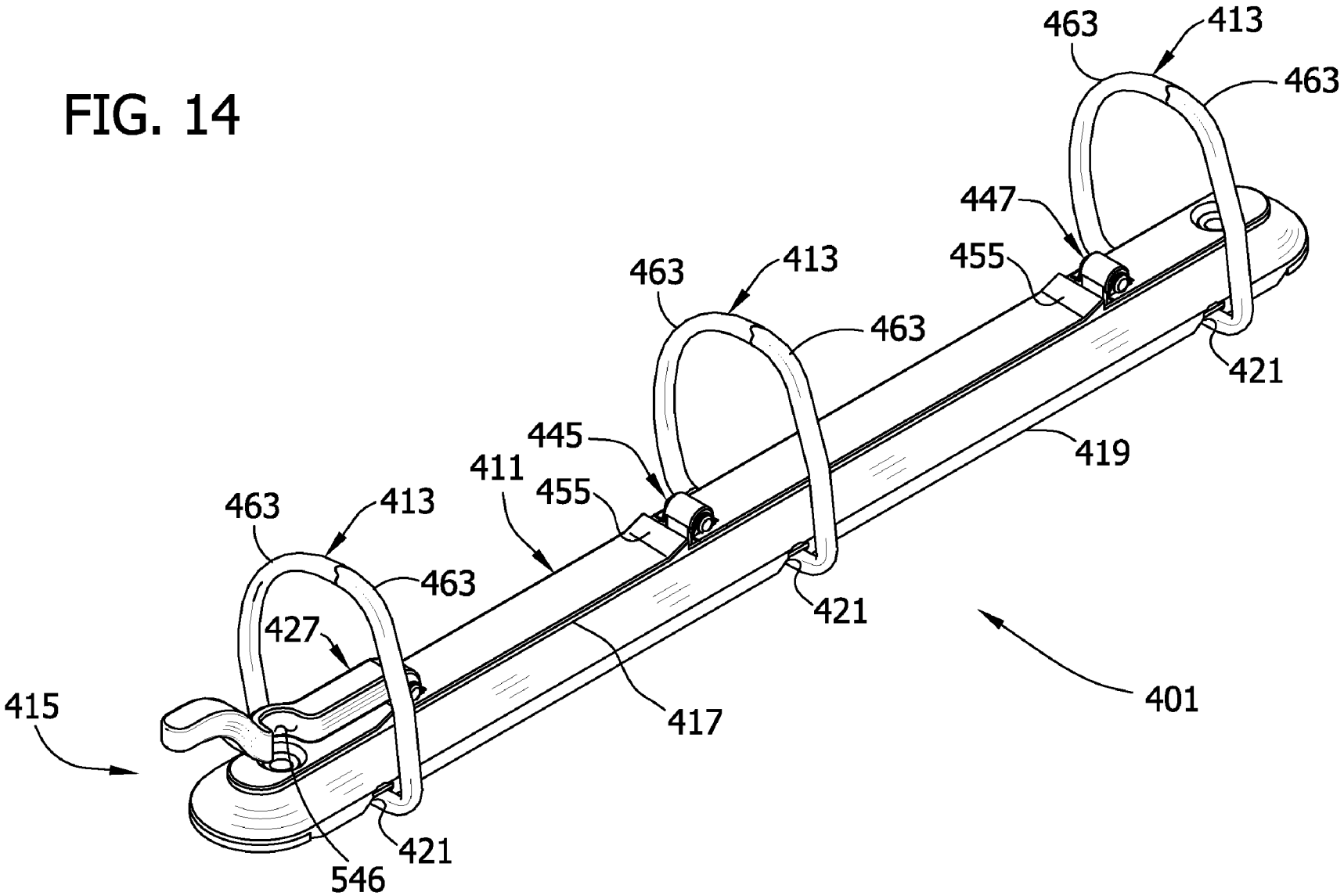
FIG. 14 is a perspective of the mechanism of FIG. 11 incorporating an alternative version of an actuating lever.

In this embodiment, the actuating lever 427 is elongate with a polygonal cross section. At one end, the lever 427 bends downward approximately 90° and wedges into a cam surface 537 that functions as a locking element, replacing the first locking element 43 of the first embodiment. Additionally at this end, two openings 539, 541 pass through side surfaces of the lever for respectively mounting the lever 427 on the housing 411 and attaching it to a travel bar 471. At the other end, the lever 427 bends twice, forming a step-shaped grasping end 543 for gripping to pivot the lever. Between the ends, and toward the grasping end 543, the lever 427 includes a circular opening 545, providing access to a circular opening 429 of the housing where a post 433 attaches the housing 411 to a spine of a notebook (not shown). It is envisioned that the actuating lever 427 is made of a plastic, however other suitable rigid materials or combination of materials, such as metal or hard rubber, may be used without departing from the scope of this invention. Additionally, mechanisms including actuating levers having differently shaped openings for receiving a mounting post do not depart from the scope of this invention (e.g., FIG. 14 illustrates the mechanism 401 with a semicircular opening 546 in the lever 427).

Figure 12:
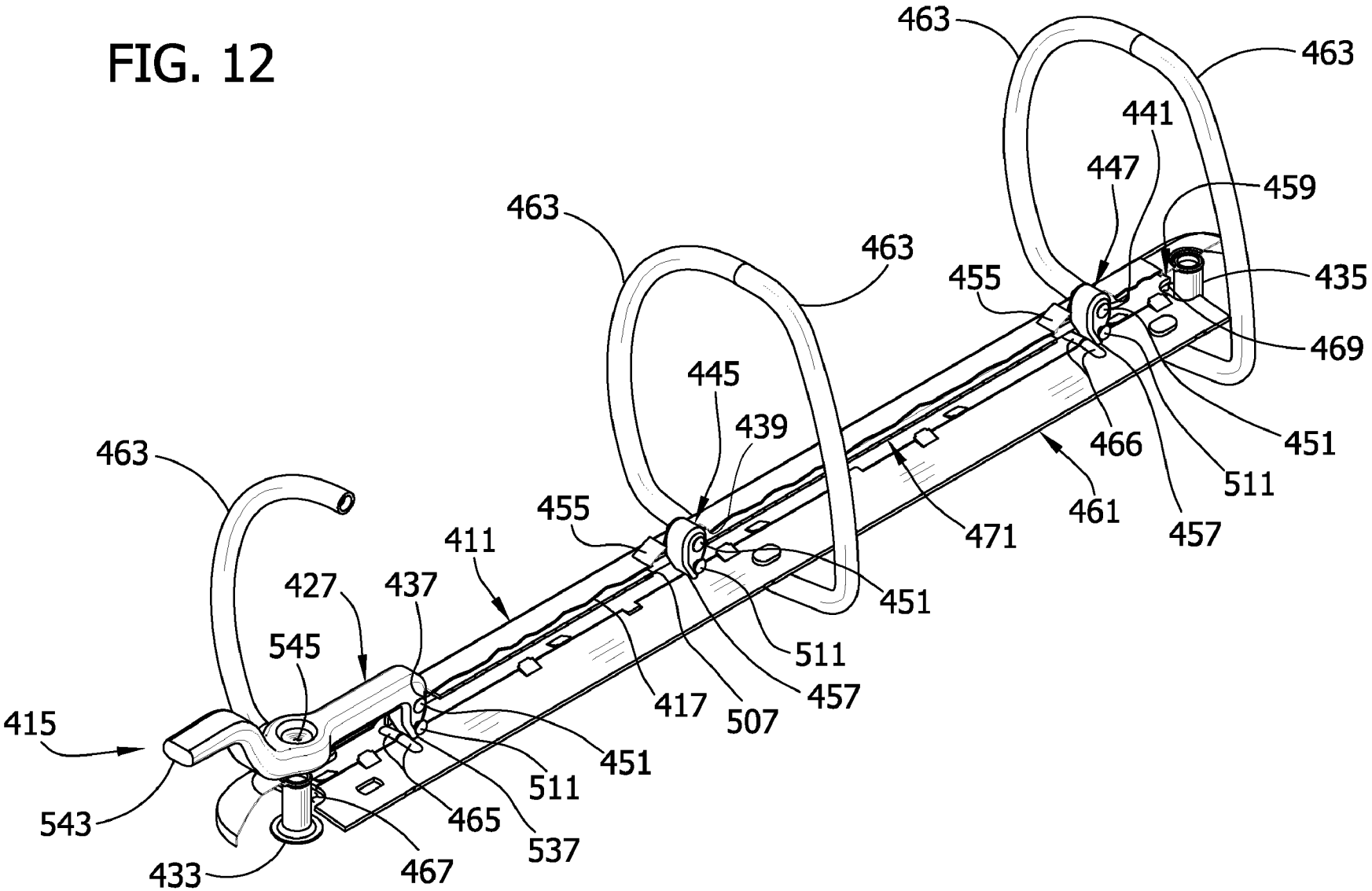
FIG. 12 is a perspective of the mechanism of FIG. 11 at a closed and locked position with a portion of a housing, a travel bar, and ring members broken away.
Figure 13:
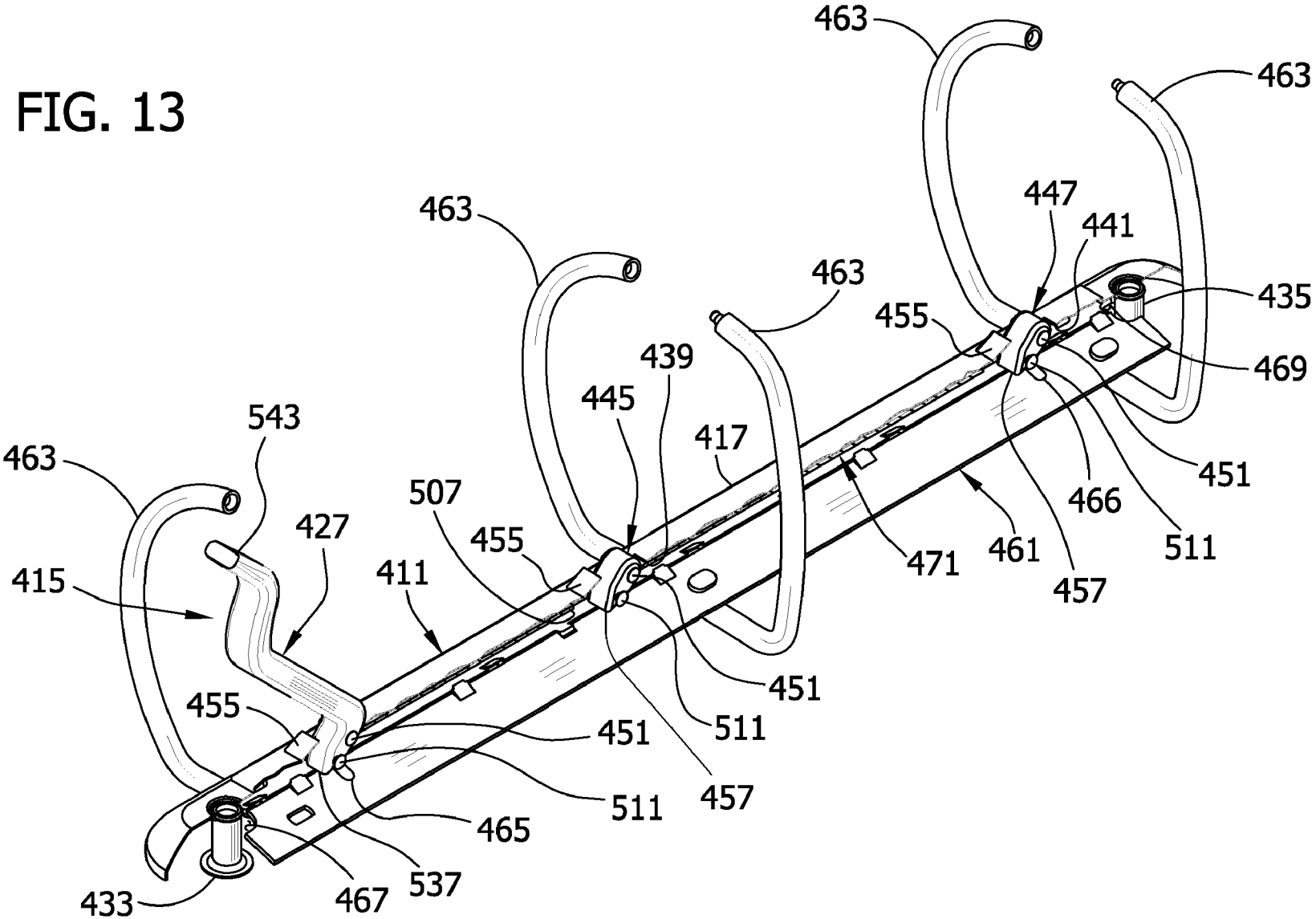
FIG. 13 is a perspective similar to FIG. 12 with the mechanism at an open position.

As illustrated in FIGS. 12 and 13, this embodiment uses no intermediate connector to transfer the actuating lever's pivoting movement into linear movement of a travel bar. Instead, the actuating lever 427 directly attaches to the travel bar 471. The cam surface 537 of the lever passes through a first rectangular opening 437 in a raised plateau of the housing and the grasping end 543 of the lever remains substantially above the housing 411. Two tabs 449 project upward from the rectangular opening 437 (see FIG. 11) and receive a hinge pin 451 through holes in the tabs and through the lever's upper opening 539, mounting the lever 427 on the housing 411. The cam surface end further passes through a first end of the travel bar. In this embodiment, this end is open and mirrors the second open end of the travel bar of the first embodiment. Two tabs 509 (see FIG. 11) project upward from this first open end and receive a hinge pin 511 through holes in the tabs and through the lever's lower opening 541, directly attaching the lever 427 to the travel bar 71. Accordingly, pivoting movement of the actuating lever directly translates the travel bar 471.

When the mechanism 401 is at a closed and locked position (FIG. 12), the openings 539, 541 in the side surfaces of the lever are vertically aligned and the lever's cam surface 537 engages the hinge plates 459, 461 behind a protrusion 465 of the interconnected plates. In order to open the mechanism 401, an operator (not shown) pivots the grasping end of the actuating lever upward and inward (FIG. 13). This pulls the travel bar 471 generally toward the lever 427, which in turn causes the locking elements 445, 447 to pivot. The cam surfaces 537, 457 of both the lever and the third locking element move over their respective protrusions 465, 466. As the lever 427 and the two locking elements 445, 447 continue to pivot, they allow the housing's spring force to pivot the hinge plates 459, 461 up. When the cam surface 537 of the lever and the cam surfaces 457 of the locking elements partially enter stalls 455 of the housing, the hinge plates 459, 461 are fully hinged upward and the ring members 463 are open. To close the mechanism 401, the operator pivots the grasping end of the actuating lever downward and outward, pushing the travel bar 471 away from the lever 427. This pivots the locking elements 445, 447 and moves the three cam surfaces 537, 457 out of the stalls 455, biasing the hinge plates 459, 461 downward against the housing's spring force, gently closing the ring members 463. The cam surfaces 537, 457 of the lever and third locking element pass over the respective protrusions 465, 466, and the lever 427 and two locking elements 445, 447 block the hinge plates pivoting motion, positively locking the ring members together.

Figure 15:
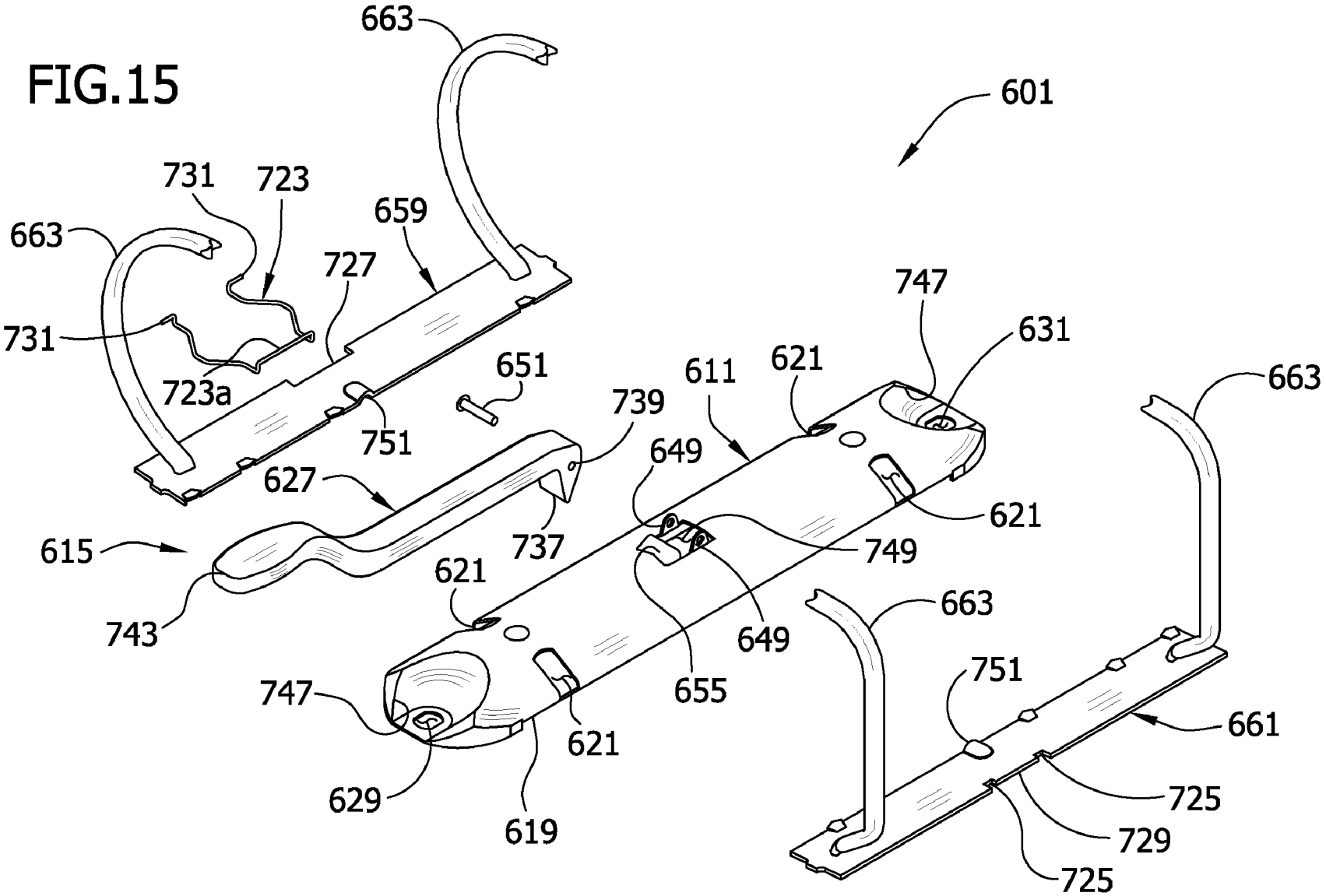
FIG. 15 is an exploded perspective of a ring binder mechanism of the present invention according to a fourth embodiment.
Figure 16:
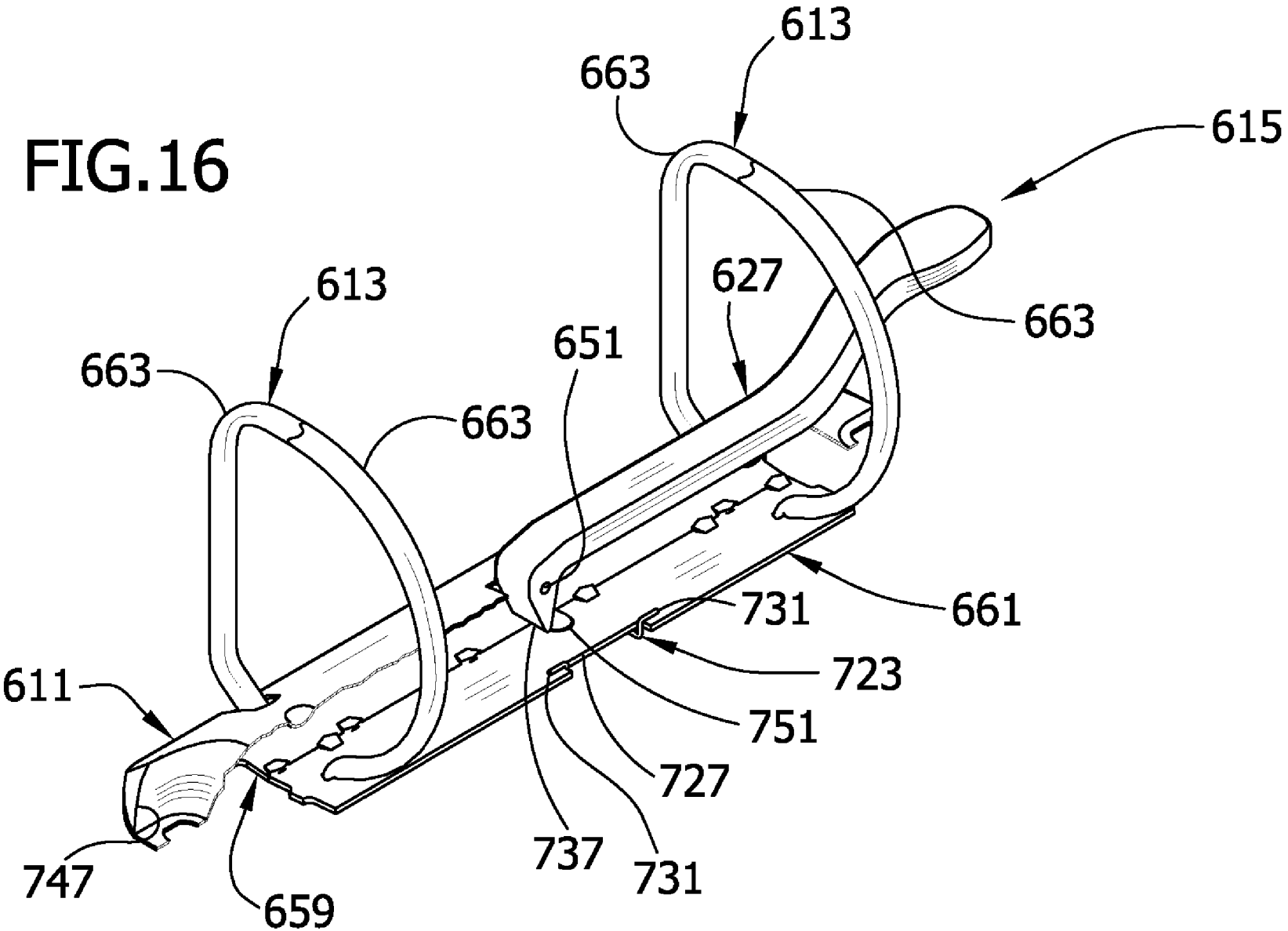
FIG. 16 is a perspective of the mechanism of FIG. 15 at a closed and locked position with a portion of a housing broken away.

FIGS. 15-18B illustrate a fourth embodiment of the present invention, generally indicated at 601. Parts of this embodiment that correspond to parts of the first embodiment are indicated by the same reference numerals, plus "600". Parts corresponding to parts of the second and third embodiments are indicated by the same reference numbers, plus "400" and "200" respectively. This embodiment is similar to the third embodiment, but as illustrated in FIG. 15 includes a control structure 615 having only an actuating lever 627 that is pivotally mounted on a housing 611 in similar fashion to the lever 427 described for the mechanism 401 of the third embodiment. The housing 611 is modified (as compared to the housing 411 of the third embodiment) to have a symmetrical, roughly arch-shaped cross section without a raised plateau at its center. The lever 627 is received through a single rectangular opening 749 in an upper surface of the housing. In addition, two ends of the illustrated housing 611 are both flattened, forming enlarged dimples 747. Each dimple 747 includes a circular opening 629, 631 therein for receiving a mounting post (not shown). Furthermore, the housing 611 includes two bent under rims 619 (only one of which is visible) that have a total of only four slots 621 arranged in two transversely opposed pairs along the length of the housing for accommodating ring members 663 of two rings (FIG. 16).

The hinge plates 659, 661 of this embodiment are similar to the hinge plates 259, 261 of the second embodiment. But in this embodiment, each hinge plate includes only a cutout 727 or a tab 729. The cutout 727 and the tab 729 are positioned along an outer longitudinal edge margin of the corresponding hinge plates, near the plates' longitudinal center. Accordingly, when the hinge plates 659, 661 interconnect, the tab 729 is across from the cutout 727, facilitating attachment of a wire form spring 723 to the underside of the interconnected plates in similar fashion to the attachment of the wire form springs 323 of the second embodiment. In addition, each hinge plate 659, 661 includes one protrusion member positioned along an inner longitudinal edge margin of the plate and located near its longitudinal center. When the plates 659, 661 interconnect, the protrusion members align to form a protrusion 751, symmetrically bridging a central hinge of the plates.

Figure 17:
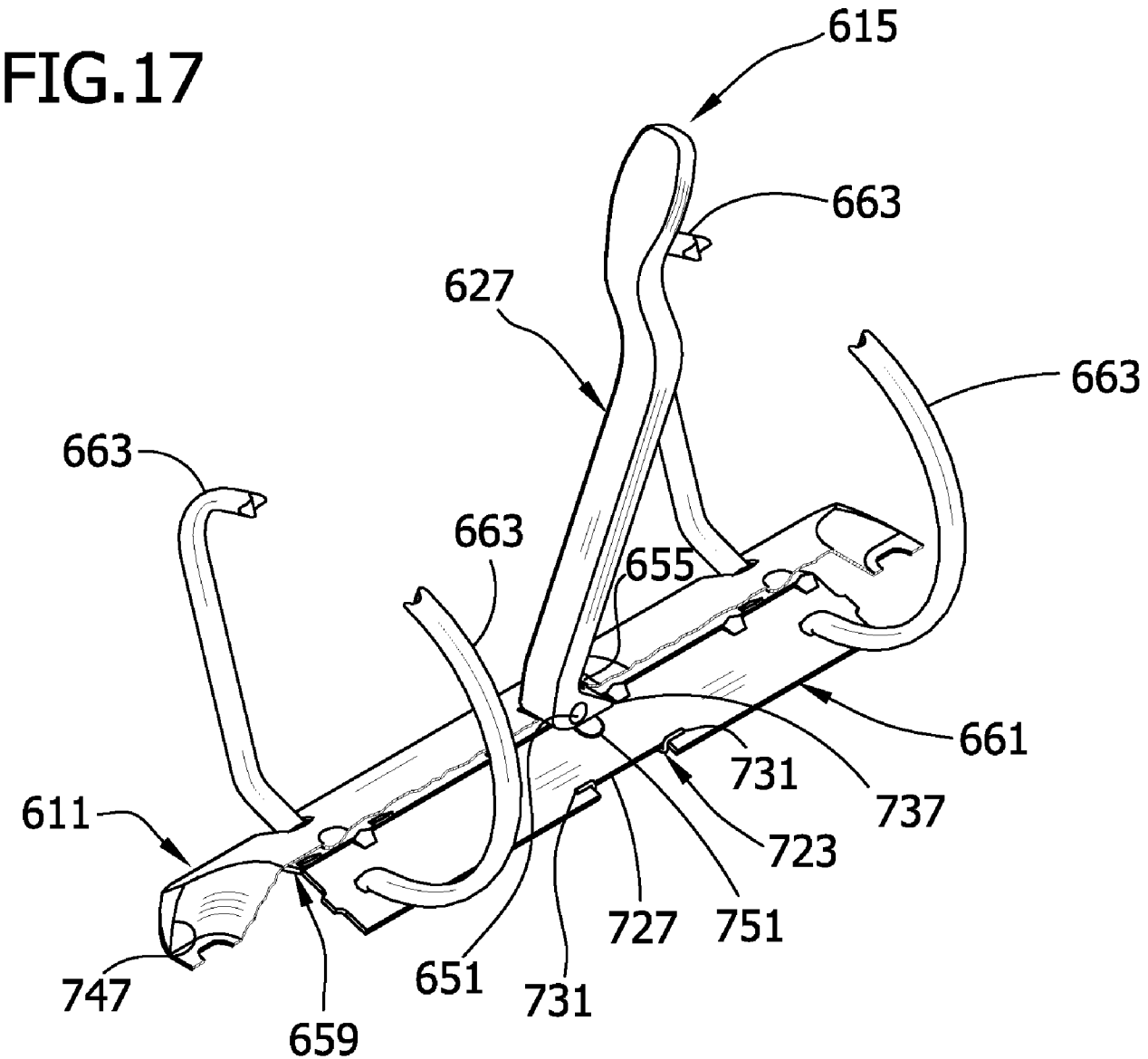
FIG. 17 is a perspective similar to FIG. 16 with the mechanism at an open position.

FIGS. 16 and 17 illustrate operation of this mechanism. At a closed and locked position, a gripping portion of the actuating lever is above the housing 611, relatively horizontal and generally parallel to the housing's upper surface (FIG. 16). A cam surface 737 of the actuating lever contacts the hinge plates 659, 661 behind the protrusion 751, positively blocking the hinge plates from pivoting. To open ring members 663 of the rings, an operator (not shown) pivots the gripping portion of the lever upward and inward (FIG. 17), moving the lever's cam surface 737 over the protrusion 751 and into a stall 655 of the housing's upper surface. As this occurs, the wire form spring 723 pivots the hinge plates 659, 661 upward and through a coplanar position (180°) of the plates in similar fashion to the wire form springs 323 of the second embodiment, opening the ring members 663. To return the mechanism 601 back to the closed and locked position, the operator pivots the lever 627 downward and outward, reversing the opening action. The lever's cam surface 737 moves out of the stall 655 and drives the hinge plates 659, 661 downward, ultimately returning to the blocking position with the cam surface 737 behind the hinge plates' protrusion 751. While in the illustrated embodiment the wire form spring 723 pivots the hinge plates 659, 661 to open the ring members 663, it is understood that hinge plates could be oriented so that a pivot axis of the plates never passes through a coplanar position (180°) of the plates and a spring force of a housing pivots the hinge plates to open ring members without departing from the scope of this invention (i.e., as described with respect to the mechanism of the first embodiment).

Figure 18A:
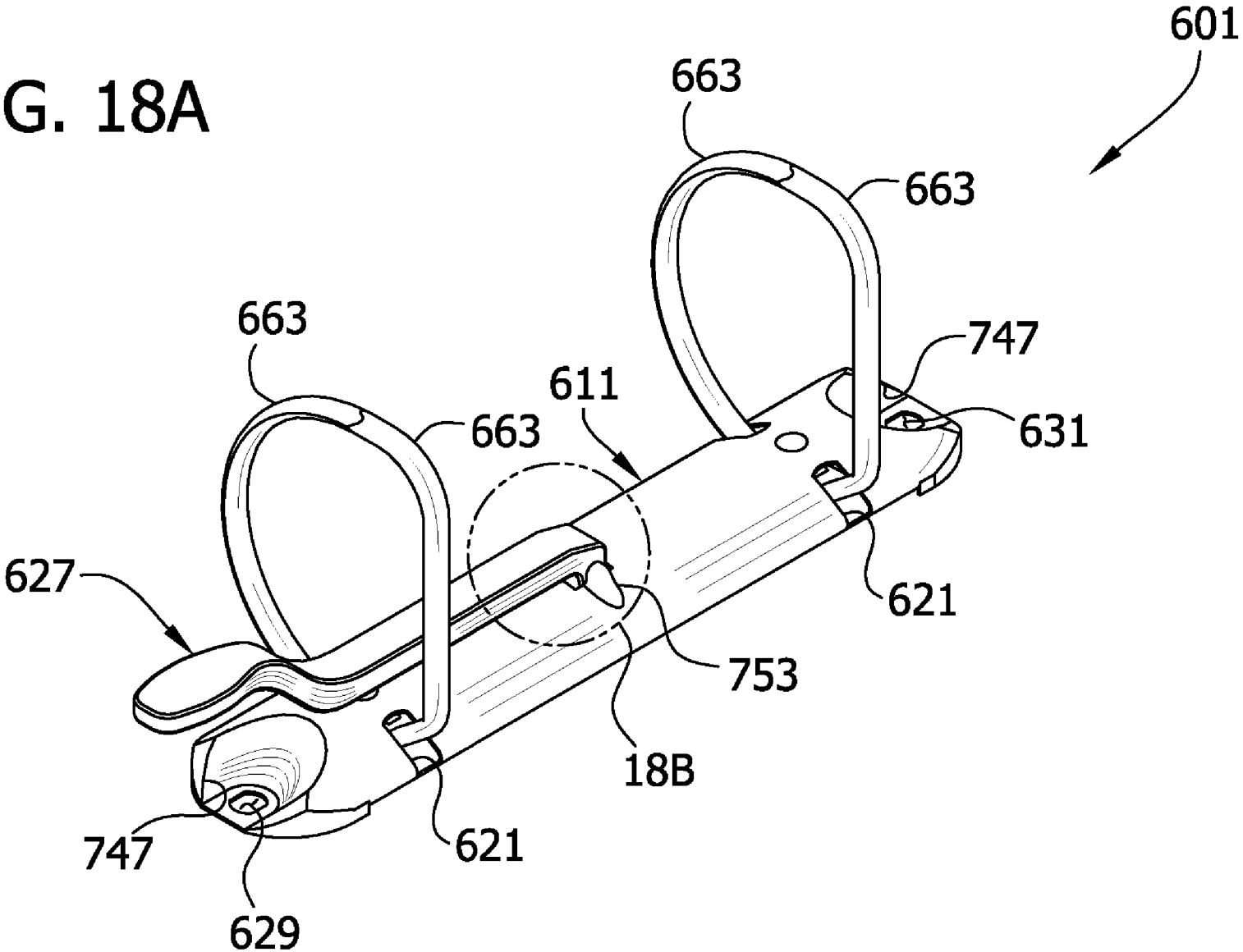
FIG. 18A is a perspective of the mechanism of FIG. 15 with an actuating lever alternatively attached to shoulders of the housing.
Figure 18B:
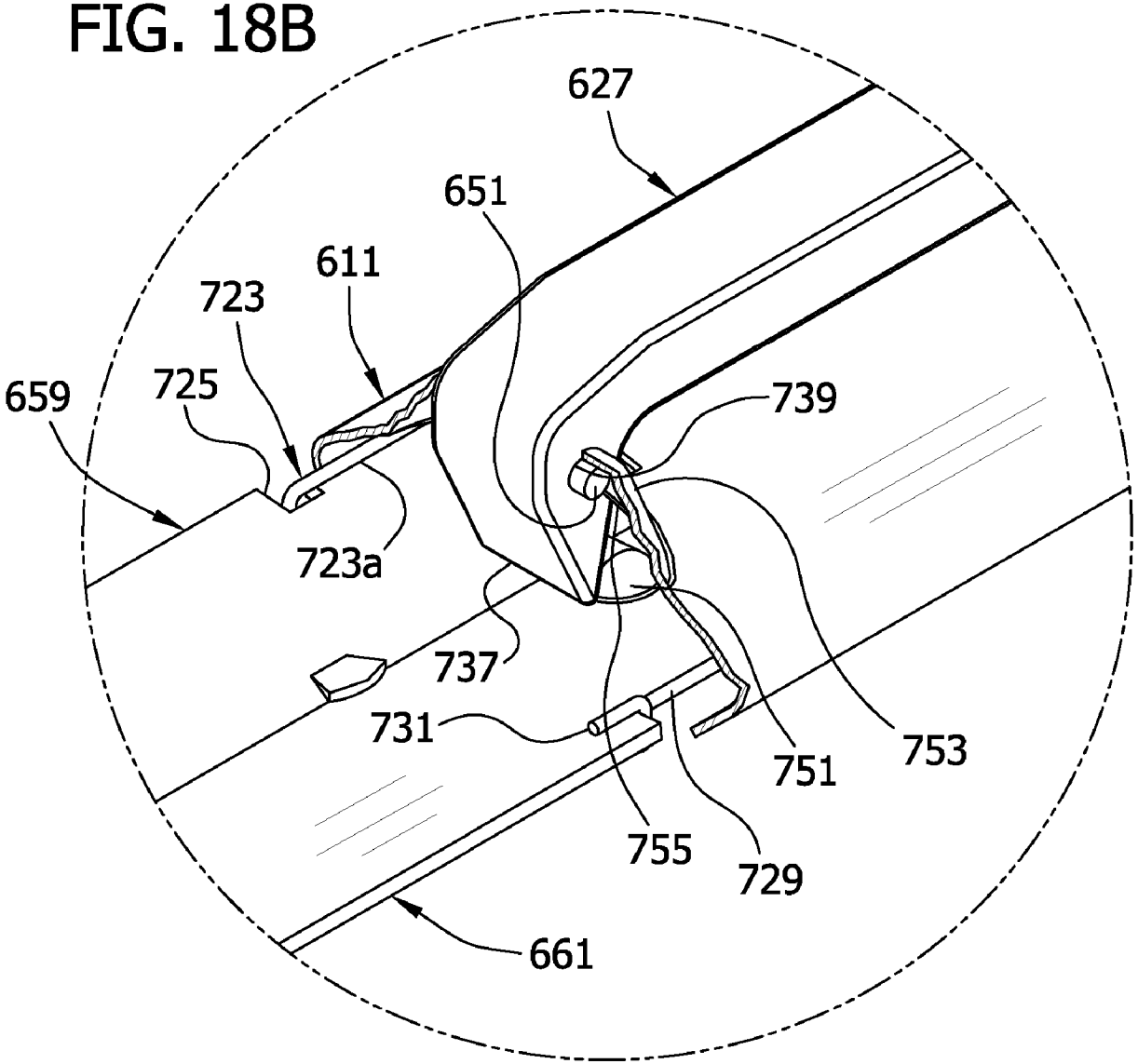
FIG. 18B is an enlarged view of the actuating lever's alternative attachment of FIG. 18A with a portion of the housing broken away.

FIGS. 18A and 18B illustrate the mechanism 601 with the actuating lever 627 mounted on the housing 611 by two shoulders 753 (only one of which is visible) of the housing. The shoulders 753 are formed by deforming the material of the housing upwardly. In this instance, a hinge pin 651 passes through an upper opening 739 of the lever and loosely rests in grooves 755 (FIG. 18B) underneath the shoulders 753, allowing the lever to pivot. In the illustrated mechanism 601, the actuating lever 627 does not include an opening for accessing a mounting post eyelet therethrough. However, mechanisms including a lever with such an opening do not depart from the scope of this invention.

Figure 19:
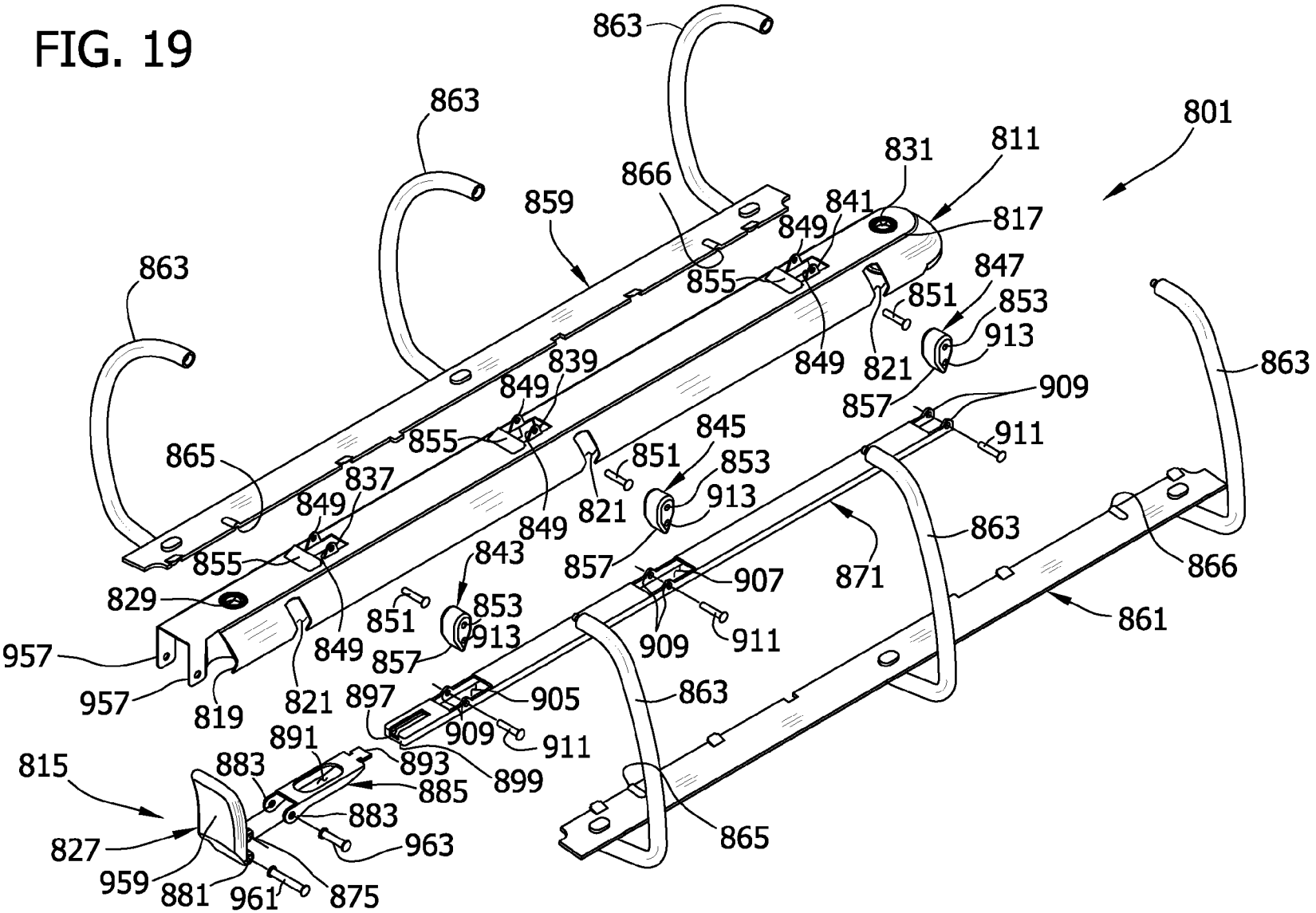
FIG. 19 is an exploded perspective of a ring binder mechanism of the present invention according to a fifth embodiment.
Figure 20:
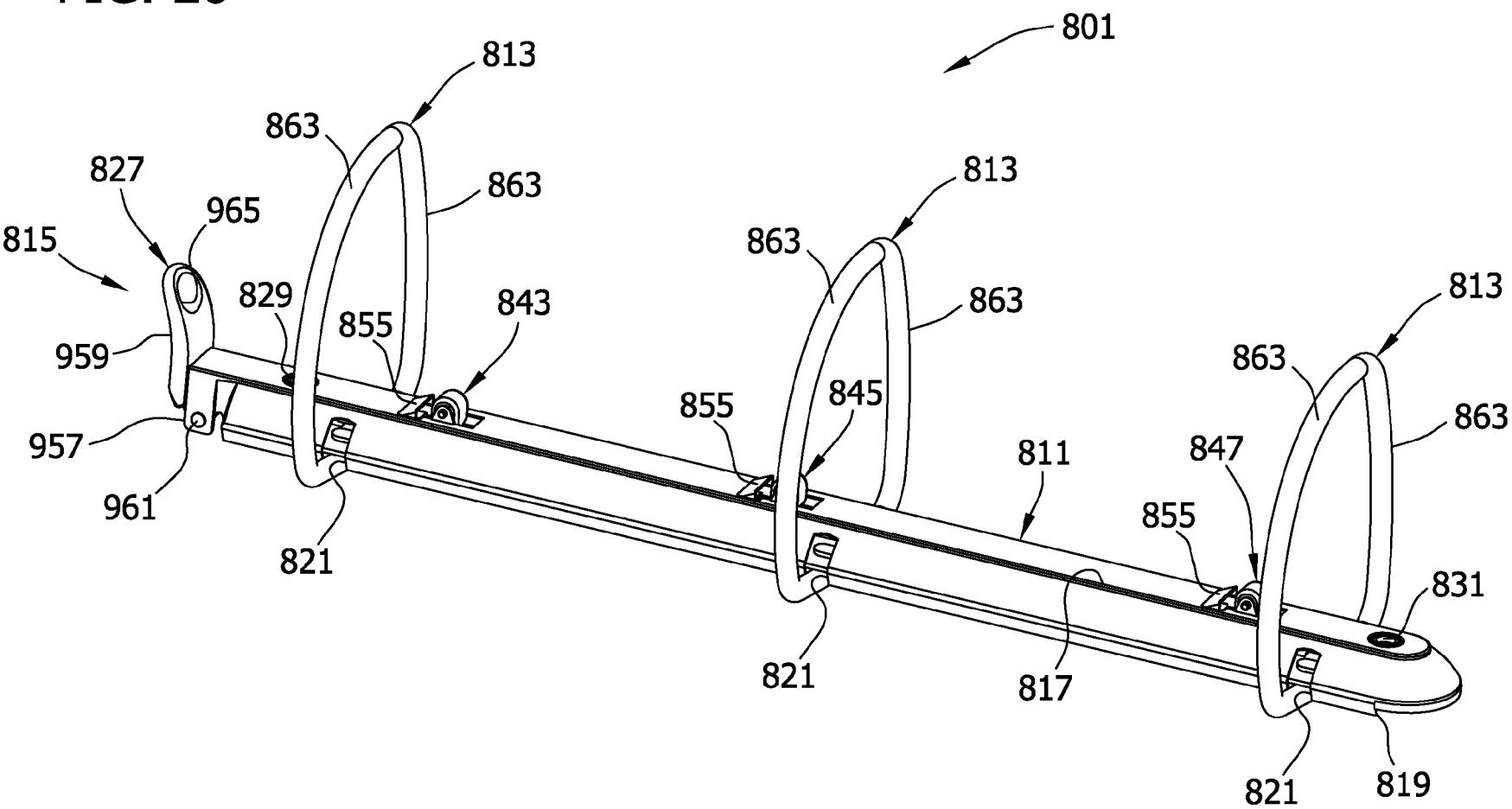
FIG. 20 is a perspective of the mechanism of FIG. 19 at a closed and locked position.

A fifth embodiment of the present invention, generally indicated 801, is shown in FIGS. 19-22. This embodiment is substantially similar to the first embodiment, and parts of this embodiment corresponding to parts of the first embodiment are indicated by the same reference numerals, plus "800". In this embodiment, as in the first embodiment, a housing 811 supports a control structure 815. As shown in FIG. 19, the control structure 815 comprises an actuating lever 827, a travel bar 871, and three locking elements 843, 845, 847 for interacting with a pair of hinge plates 859, 861 and moving ring members 863 attached thereto between an open position and a closed position. In this embodiment, however, the housing 811 includes two tabs 957 projecting downward from one end of the housing for mounting the actuating lever 827 on the housing 811. Also in this embodiment, the actuating lever 827 includes a generally uniform body (as compared to the actuating lever 27 of the first embodiment which includes the enlarged head 73). As shown in FIG. 20, the uniform body of the lever 827 includes a gentle bow near a top, gripping end, slightly arcing the lever outward and away from the housing 811. In addition, the gripping end includes a circular indentation 965 that, together with the arcing shape of the lever, facilitates grasping the lever 827 for pivoting to open and close the ring members 863. Referring back to FIG. 19, a first hinge pin 961 passes through holes in the housing's tabs and through openings 881 in the lever 827 (only one opening 881 in the lever is visible) for pivotally mounting the lever 827 on the housing 811. A second hinge pin 963 passes through a pair of upper openings 875 in the lever 827 (only one opening 875 in the lever is visible) and through openings 883 in an intermediate connector 885, which as in the first embodiment transforms pivoting motion of the lever into substantially linear travel bar motion.

Figure 21:
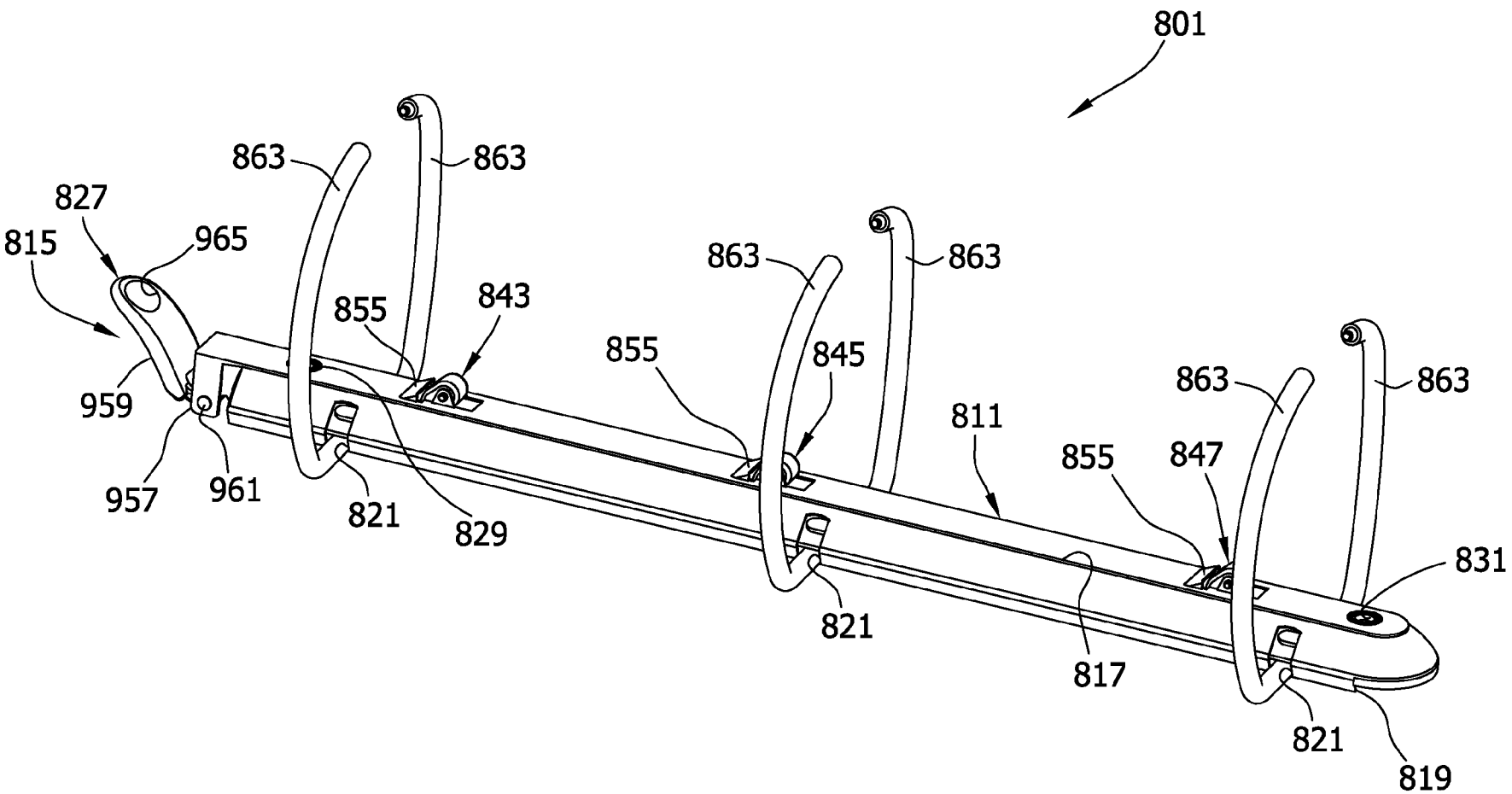
FIG. 21 is a perspective similar to FIG. 20 with the mechanism at an open position.
Figure 22:
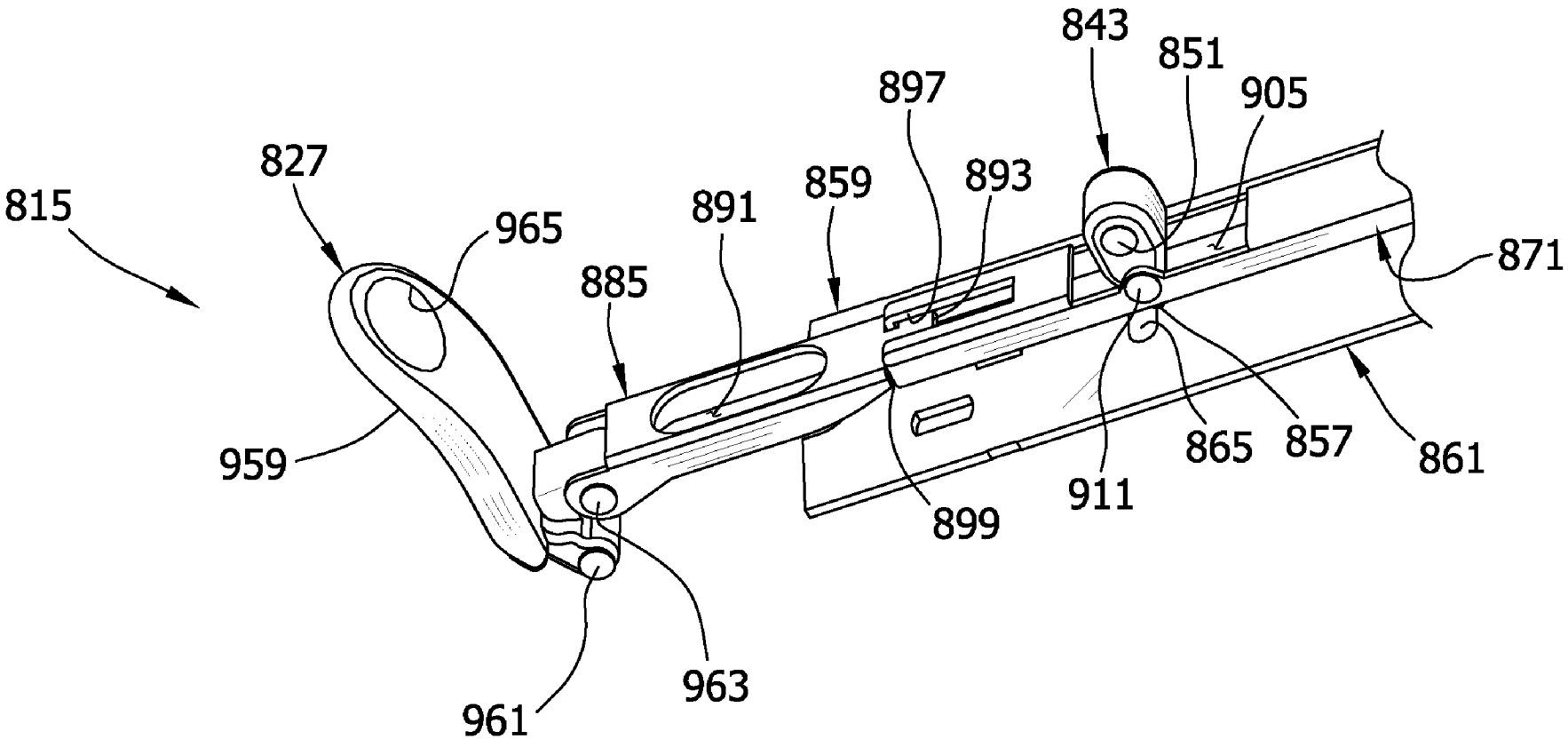
FIG. 22 is a fragmentary perspective of the mechanism of FIG. 20 with a housing and ring members removed.

Referring now to FIGS. 19-21, to open the ring members 863, an operator (not shown) pivots the lever 827 outward and downward about hinge pin 961. The intermediate connector 885 and the travel bar 871 move toward the end of the housing 811 having the lever 827. As in the first embodiment, this causes the locking elements 843, 845, 847 to pivot. A cam surface 857 of a first and third locking element 843, 847 moves over a respective protrusion 865, 866 on a pair of hinge plates, and the cam surface 857 of all three locking elements moves into a respective stall 855 of the housing. In this embodiment, each stall 855 is located on an opposite side of a rectangular opening 837, 839, 841 of the housing for accommodating the movement of the travel bar toward the lever 827 when opening the ring members 863. To close the ring members 863, the operator pivots the lever 827 inward and upward, pushing the intermediate connector 885 and travel bar 871 back away from the lever 827 and returning the locking elements 843, 845, 847 to a locking position.

Components of the various embodiments of the ring binder mechanism of the present invention are made of a suitable rigid material, such as metal (e.g., steel). But mechanisms made of a nonmetallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

Moreover, the use of "up" and "down" and variations thereof is made for convenience, but does not require any particular orientation of the components.

As various changes could be made in the above ring binder mechanisms without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the ring binder mechanism being adapted to be fastened to a cover using at least one fastener, the mechanism comprising:

a housing having longitudinal ends and a top surface;

hinge plates supported by the housing for pivoting motion about a pivot axis relative to the housing;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings; and a control structure supported by the housing and movable relative to the housing, the control structure producing the pivoting motion of the hinge plates in at least one direction;

wherein the control structure comprises an actuating lever pivotally connected to the housing and disposed generally above the top surface of the housing, the actuating lever being formed for receiving said fastener therethrough for connecting the housing to said cover, and wherein the control structure further includes a travel bar, movable in translation relative to both the housing and the hinge plates, and a locking element, pivotally connected to the housing and to the travel bar.

2. A ring binder mechanism as set forth in claim 1 wherein the actuating lever includes an end portion received through an opening in the top surface of the housing.

3. A ring binder mechanism as set forth in claim 2 wherein the actuating lever includes a gripping portion disposed above the top surface of the housing for grasping to pivot the actuating lever, the actuating lever further including an opening between the end portion and the gripping portion for receiving the fastener therethrough.

4. A ring binder mechanism as set forth in claim 1 wherein the hinge plates are supported by the housing such that an angle formed by exterior surfaces of the hinge plates never passes through 180° during the pivoting motion of the hinge plates.

5. A ring binder mechanism as set forth in claim 1 further comprising a spring for producing the pivoting motion of the hinge plates bringing the ring members to the open position.

6. A ring binder mechanism as set forth in claim 1 wherein at least one of the hinge plates includes a protrusion, the protrusion being engageable with the control structure for releasably holding the control structure in a locking position where the control structure blocks the pivoting motion of the hinge plates that brings the ring members to said open position.

7. A ring binder mechanism as set forth in claim 1 wherein the housing includes a stall on said top surface, the stall at least partially receiving the control structure when the ring members are in said open position.

8. A ring binder mechanism as set forth in claim 1 in combination with said cover, the ring binder mechanism being mounted on the cover, the cover being hinged for movement to selectively cover and expose loose-leaf pages retained on the ring binder mechanism.

9. A ring binder mechanism for retaining loose-leaf pages, the ring binder mechanism being adapted to be fastened to a cover using at least one fastener, the mechanism comprising:

a housing having longitudinal ends and a top surface;

hinge plates supported by the housing for pivoting motion about a pivot axis relative to the housing;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings; and a control structure supported by the housing and movable relative to the housing, the control structure producing the pivoting motion of the hinge plates in at least one direction;

wherein the control structure comprises an actuating lever pivotally connected to the housing and disposed generally above the top surface of the housing, the actuating lever being formed for receiving said fastener therethrough for connecting the housing to said cover, and wherein the hinge plates are supported by the housing such that an angle formed by exterior surfaces of the hinge plates never passes through 180° during the pivoting motion of the hinge plates.

10. A ring binder mechanism as set forth in claim 9 wherein the actuating lever includes an end portion received through an opening in the top surface of the housing.

11. A ring binder mechanism as set forth in claim 10 wherein the actuating lever includes a gripping portion disposed above the top surface of the housing for grasping to pivot the actuating lever, the actuating lever further including an opening between the end portion and the gripping portion for receiving the fastener therethrough.

12. A ring binder mechanism as set forth in claim 9 further comprising a spring for producing the pivoting motion of the hinge plates bringing the ring members to the open position.

13. A ring binder mechanism as set forth in claim 9 wherein at least one of the hinge plates includes a protrusion, the protrusion being engageable with the control structure for releasably holding the control structure in a locking position where the control structure blocks the pivoting motion of the hinge plates that brings the ring members to said open position.

14. A ring binder mechanism as set forth in claim 9 wherein the housing includes a stall on said top surface, the stall at least partially receiving the control structure when the ring members are in said open position.

15. A ring binder mechanism as set forth in claim 9 in combination with said cover, the ring binder mechanism being mounted on the cover, the cover being hinged for movement to selectively cover and expose loose-leaf pages retained on the ring binder mechanism.

16. A ring binder mechanism for retaining loose-leaf pages, the ring binder mechanism being adapted to be fastened to a cover using at least one fastener, the mechanism comprising:

a housing having longitudinal ends and a top surface;

hinge plates supported by the housing for pivoting motion about a pivot axis relative to the housing;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings; and a control structure supported by the housing and movable relative to the housing, the control structure producing the pivoting motion of the hinge plates in at least one direction;

wherein the control structure comprises an actuating lever pivotally connected to the housing and disposed generally above the top surface of the housing, the actuating lever being formed for receiving said fastener therethrough for connecting the housing to said cover, and wherein at least one of the hinge plates includes a protrusion, the protrusion being engageable with the control structure for releasably holding the control structure in a locking position where the control structure blocks the pivoting motion of the hinge plates that brings the ring members to said open position.

17. A ring binder mechanism as set forth in claim 16 wherein the actuating lever includes an end portion received through an opening in the top surface of the housing.

18. A ring binder mechanism as set forth in claim 17 wherein the actuating lever includes a gripping portion disposed above the top surface of the housing for grasping to pivot the actuating lever, the actuating lever further including an opening between the end portion and the gripping portion for receiving the fastener therethrough.

19. A ring binder mechanism as set forth in claim 16 further comprising a spring for producing the pivoting motion of the hinge plates bringing the ring members to the open position.

20. A ring binder mechanism as set forth in claim 16 wherein the housing includes a stall on said top surface, the stall at least partially receiving the control structure when the ring members are in said open position.

21. A ring binder mechanism as set forth in claim 16 in combination with said cover, the ring binder mechanism being mounted on the cover, the cover being hinged for movement to selectively cover and expose loose-leaf pages retained on the ring binder mechanism.

* * * * *